US011282536B2

(12) United States Patent
Davis et al.

(10) Patent No.: US 11,282,536 B2
(45) Date of Patent: Mar. 22, 2022

(54) SYSTEMS AND METHODS FOR DETECTING A GUNSHOT

(71) Applicant: UTILITY ASSOCIATES, INC., Decatur, GA (US)

(72) Inventors: Ted Michael Davis, Decatur, GA (US); Eric H Bedell, Marietta, GA (US); Robert S McKeeman, Atlanta, GA (US)

(73) Assignee: UTILITY ASSOCIATES, INC., Decatur, GA (US)

( * ) Notice: Subject to any disclaimer, the term of this patent is extended or adjusted under 35 U.S.C. 154(b) by 0 days.

(21) Appl. No.: 17/198,568

(22) Filed: Mar. 11, 2021

(65) Prior Publication Data

US 2021/0233555 A1 Jul. 29, 2021

Related U.S. Application Data

(63) Continuation of application No. 16/886,688, filed on May 28, 2020.

(60) Provisional application No. 62/853,437, filed on May 28, 2019.

(51) Int. Cl.

| | |
|---|---|
| ***G10L 25/51*** | (2013.01) |
| ***G10L 19/02*** | (2013.01) |
| ***G10L 25/24*** | (2013.01) |
| ***G10L 25/06*** | (2013.01) |
| ***G10L 25/18*** | (2013.01) |
| *F41H 11/00* | (2006.01) |

(52) U.S. Cl.

CPC ..... *G10L 25/51* (2013.01); *G10L 19/02* (2013.01); *G10L 25/06* (2013.01); *G10L 25/18* (2013.01); *G10L 25/24* (2013.01); *F41H 11/00* (2013.01)

(58) Field of Classification Search

CPC ..... G10L 25/51; G10L 25/24; G10L 25/06; G10L 19/02; G10L 25/18; F41H 11/00

USPC ..... 704/503, 229; 381/71.1, 71.4

See application file for complete search history.

(56) References Cited

U.S. PATENT DOCUMENTS 6,167,192 A * 12/2000 Heo ..... G11B 27/3027 386/244
6,356,872 B1 * 3/2002 Leung ..... G10L 21/0364 704/229
7,003,358 B2 * 2/2006 Eastty ..... G11B 20/10527 330/207 A
7,577,259 B2 * 8/2009 Iwata ..... G10L 21/038 381/61

(Continued)

OTHER PUBLICATIONS

Deploying Acoustic Detection Algorithms on Low-Cost, Open-Source Acoustic Sensors for Environmental Monitoring (Year: 2019).*

*Primary Examiner* — Akwasi M Sarpong
(74) *Attorney, Agent, or Firm* — Meunier Carlin & Curfman LLC

(57) ABSTRACT

Systems and methods for detecting a gunshot event are disclosed. More particularly, systems and methods for detecting a gunshot event using the ultrasonic frequency distribution across a broad range of frequencies resulting from a gun's muzzle blast to determine whether an actual gunshot event has occurred and to minimize false positives and false negatives are disclosed. Yet further, systems and methods for determining the location of an actual gunshot event by utilizing the decay of the frequency distribution across a broad range of frequencies resulting from a gun's muzzle blast are disclosed.

26 Claims, 12 Drawing Sheets

(56) References Cited

U.S. PATENT DOCUMENTS

| | | | | |
|---|---|---|---|---|
| 8,199,923 | B2 * | 6/2012 | Christoph | G10K 11/17854 381/71.1 |
| 9,111,047 | B1 * | 8/2015 | Shridhar | G06F 13/40 |
| 10,089,845 | B2 * | 10/2018 | Skorpik | G08B 21/02 |
| 10,115,410 | B2 * | 10/2018 | Craven | G10L 19/0204 |
| 10,763,828 | B2 * | 9/2020 | Craven | H03H 17/0261 |
| 2011/0218952 | A1 * | 9/2011 | Mitchell | G10L 15/02 706/12 |
| 2014/0361886 | A1 * | 12/2014 | Cowdry | G08B 13/1672 340/522 |
| 2015/0194045 | A1 * | 7/2015 | Edwards | G08B 13/1672 340/540 |
| 2016/0042767 | A1 * | 2/2016 | Araya | H04N 7/188 386/201 |
| 2016/0191163 | A1 * | 6/2016 | Preston | H04B 10/2575 398/16 |
| 2016/0260307 | A1 * | 9/2016 | Skorpik | G08B 21/02 |
| 2017/0110141 | A1 * | 4/2017 | Craven | G10L 19/022 |
| 2017/0169686 | A1 * | 6/2017 | Skorpik | G01S 5/18 |
| 2018/0159473 | A1 * | 6/2018 | Nestler | H03H 11/04 |
| 2019/0180606 | A1 * | 6/2019 | Pirkle | H04R 3/005 |
| 2020/0088832 | A1 * | 3/2020 | Jarrett | G08B 13/1654 |
| 2020/0381006 | A1 * | 12/2020 | Davis | G10L 25/24 |
| 2020/0402378 | A1 * | 12/2020 | Connell, II | H04L 41/06 |

* cited by examiner

SYSTEMS AND METHODS FOR DETECTING A GUNSHOT

CROSS-REFERENCE TO RELATED APPLICATIONS

This application is a continuation of U.S. application Ser. No. 16/886,688, filed on May 28, 2020, which claims the benefit of U.S. Provisional Application No. 62/853,437, filed on May 28, 2019, the contents of which are incorporated herein by reference in their entirety.

BACKGROUND

The present disclosure generally relates to a system and method for autonomously detecting the sound of a gunshot, which improve upon the prior art by addressing gunshot detection "false positives" and "false negatives." In this context, a gunshot detection false positive is an event that was identified as being a gunshot but was not actually a gunshot. A gunshot detection false negative is an event in which a gunshot actually did occur, but the gunshot event was not detected. These gunshot detection misclassifications are referenced herein simply as false positives and false negatives. The systems and methods further provide for detecting the location of the gunshot sound.

The desired benefits of detecting and accurately determining a gunshot are many. For example, a "Shots Fired" report, whether in an urban area, school, church, office, business or elsewhere, can trigger a significant response. Nearby law enforcement officers and first responders may drop whatever they are doing to rush to the scene. Perimeter cordons are set up and the area may be locked down and/or evacuated. Overall there is a significant disruption of normal community activity. Police officers responding to a such a report are faced with significant uncertainty as a first priority may include determining if, in fact, there was a gunshot event and if so, where the gunshot event occurred. Such circumstances can call for police officers to make split-second decisions with incomplete and imperfect information and risk mistakenly identifying an innocent bystander as a possible shooter; "friendly fire" mistakes are possible. Similarly, innocent citizens in the vicinity of a possible gunshot event, particularly at night, may not be able to distinguish between a first responder and a threatening person with a gun such as an assailant or home invader. As a result, a citizen may fire a weapon at a first responder in a good faith belief they are defending life and property or acting in self-defense.

In any gunshot report and/or detection effort, it is desirable to address instances of false positives and false negatives. A false positive, for example, can cause first responder resources to triage or even ignore other gunshot reports. In the case of an actual gunshot event, response delays can have negative results to life and property. False positive reports may also cause so-called "Red Flag" alerts, where police officers may believe that gunshots have repeatedly occurred at a location. In some states, a Red Flag alert or law warrants and/or authorizes seizing weapons from persons who are believed on some basis, including reports of unlawful weapons discharge, to be a threat to the community. A Red Flag SWAT team entering a home or business upon report of a gunshot may encounter a citizen with a legal right to possess a firearm. The risks to both first responders and citizens are exacerbated in the event of a false positive report at that location and/or in the area. Thus, minimizing false positives (and false negatives) and improving the timeliness of correct classification or identification of a gunshot event is desired.

Given the history of mass shooting events, almost any gunshot report or response is likely to increase the public's overall anxiety level. A full (yet necessary) police response to a false positive report will likely cause additional fear, uncertainty, and doubt amongst the public, including school children, teachers, parents, office workers, worshippers, shoppers, residents, visitors, et al, even if there is no actual gunshot event or shooter. Overall confidence in public safety can decline if gunshot events are falsely reported. Like false positive fire alarms or alerts, and/or car horn panic button alerts, false positives gunshot reports may result in future such reports being more likely discounted or even ignored. False positives might even cause delays in first responders reacting to future actual gunshot incidents, and/or cause inadequate resources to initially be dispatched to actual gunshot events, while time is spent trying to determine if there really is an actual gunshot event.

For these and other reasons, efforts have been made to detect a gunshot event using sensor technology. But accurately determining the existence of an actual gunshot as opposed to a loud noise that may seem to be a gunshot using such technology is a difficult task. Two prior art gunshot detection efforts are seen in U.S. Pat. No. 5,917,775 (Salisbury) patent and U.S. Pat. No. 10,089,845 (Skorpik). Generally speaking, these references disclose using acoustic energy as a basis for deciding if a sound event is a gunshot. The Salisbury '775 Patent uses a piezoelectric microphone to capture sound energy level which is converted to digitized binary codes. The binary codes are compared with certain gunshot detection criteria to judge whether a detected sound is a gunshot. The Skorpik '845 Patent teaches acquiring sound data by use of a cellphone microphone and using filtering, band pass analog signal processing, to isolate the sound energy level within a given frequency band, primarily in the frequency domain below 30 kHZ. Generally described, both of the Salisbury '775 and Skorpik '845 references are directed to capturing sound data that is generally within a frequency range of human hearing, and any captured loud noise sound that exceeds a pre-defined acoustic energy value threshold can be classified to be a gunshot.

There are sounds, both naturally occurring and otherwise, that will generate energy levels and waveforms that may be classified as gunshots by devices according to Salisbury '775 and Skorpik '845 but not be gunshots and thus constitute false positives. For example, with reference to the Skorpik '845 teaching, a naturally occurring sound within the frequency domain below 30 kHz, the relevant upper frequency limit identified by Skorpik's prior art, can potentially be classified as a gunshot. Moreover, Skorpick '845 provides that a cellphone microphone may be utilized to detect audio sounds. Given that cellphone microphones typically have a maximum sampling rate within the 44 thousand cycles per second range, the Nyquist Sampling Theorem teaches that such devices are limited to digitally reproducing/recording audio signals having a frequency content of 22 kHz or below. Skorpik's acknowledgment of a cellphone as a viable embodiment for gathering possible gunshot sound data reinforces its reliance on effectively the human hearing range as being the basis upon which to make a gunshot sound classification.

Skorpik '845 also discloses capturing frequency data in a second frequency range between 0.9 MHz and 1.0 MHz, but only the sound having frequencies below 30 kHz is used to distinguish between threat and non-threat events. Skorpik '845 uses sounds in the 0.9 MHz to 1.0 MHz frequency range for the sole purpose of counting possible gunshots. Further, referencing the International Standard document ISO 9613-1:1993 Part 1 "Calculation of the absorption of sound by the atmosphere," and applying the formulas within section 6.2 of that work, it is to be understood that a 1.0 MHz frequency sound decays within approximately 3 feet of its source. Thus, Skorpik '845 has an inherent distance limitation (165 dB 1.0 MHz signal source decays to 0 dB in 3.39 feet) that can influence application of the disclosed teaching. Skorpik '845 also teaches the use of filtering out other frequency content in favor of sampling/isolating the specific frequency range between 0.9 MHz to 1.0 MHz range.

Further prior art gunshot detection efforts are seen U.S. Pat. No. 6,847,587 (Patterson) and U.S. Pat. No. 7,961,550 (Calhoun). Generally speaking, these references are directed to a network of audio microphones to recognize the location of acoustic events, including gunshots. The Patterson '587 reference generally discloses a "known acoustic event" that is identified by receiving acoustic waves at a sensor, and then compares those waves to a stored envelope and spectral characteristics of an acoustic event (gunshot). If there is a minimum pre-determined correlation (of sound envelope points and spectral characteristics), then the "acoustic event" location is estimated based upon triangulation between microphones. It is believed that many sounds that are not gunshots will have a high correlation using this methodology (i.e., there will be false positives and false negatives).

The Calhoun '550 reference generally describes a system and method to segregate data from different gunshot events that are in close time proximity. More particularly, the Calhoun '550 reference focuses on transforming sound data into time pulse subsets, and matching the time pulse subsets to known gunshot time pulse subsets. There is processing that purports to distinguish between multiple gunshots in close time proximity, where long distance and echoes off hard surfaces and the relatively slow speed of sound can result in the sound pulse subsets to overlap each other. For example, some portion of a sound from Gunshot 1 may arrive at a distant microphone after a sound from Gunshot 2 arrives at that same microphone. The Calhoun '550 patent generally describes a system and method to segregate data from different gunshot events that are in close time proximity. In both of the Patterson '587 and Calhoun '550 patents, a primary teaching is on a triangulating methodology and related disclosures for determining the physical location of a gunshot-like sound.

Yet further, the U.S. Army began The Joint Counter Sniper Program in 1993. This work led to the formulation of requirements, prototyping, and technology demonstrations accomplished by 1994. This further led to the Defense Advanced Research Projects Agency (DARPA) developing initiatives for a state-of-the-art gunshot detection technology. Ultimately, six well-known defense technology companies were sponsored by DARPA to develop prototypes of various kinds. These systems were subsequently evaluated in 1997 at the U.S. Marine Corps Base at Camp Pendleton. The SECURES (System for Effective Control of Urban Environment Security) was spun out of these US Government efforts and later merged to form the well-established US based company, ShotSpotter Inc. These efforts were significant and based on substantial engineering and scientific resources. Even so, the activation rate produced by "actual gunshots" for then current state-of-the-art systems was less than optimal.

Prior art systems continue to misclassify gunshot events as a short-duration sound containing high-energy content that spans the frequencies from 20 Hz to 22 KHz, the human hearing range, as a gunshot. One inherent long-standing difficulty is and has been identifying true gunshots out of a range of events that generate similar short-duration, high-energy audio sounds and their associated wave patterns. For example, something as innocuous as two boards slapped together or a slammed toilet seat can produce such a sound. Given the abundance of natural and mechanical means for generating such sounds, erroneous reports are unavoidable and arguably common if prior art devices were to be placed in noisy environments. While the prior art has sought to develop a highly reliable system that can autonomously and accurately detect a gunshot by only using acoustic information, prior art efforts have had difficulty distinguishing between short-duration, high-energy audio sounds (and associated wave patterns) that are and/or are not a gunshot event and therefore, false positives and false negatives result.

Artificial Intelligence (AI) has been utilized in the classification of acoustic events in the effort to reliably detect a gunshot event. The reliability of prior art AI-based systems to properly classify acoustic samples is, however, limited by the quantity and quality of its training set and how it is implemented. As with the prior art teaching discussed above, the sampling methods used by prior art devices to develop information available for AI efforts has focused on gunshot muzzle blast acoustic data within the range of human hearing. For example, prior art acoustic gunshot event samples include research initially funded and conducted by the military. The Naval Surface Weapons Center in 1975 looked at tracking bullets and artillery by acoustic means. This effort was followed by the U.S. Army Corps of Engineers Construction Engineering Laboratories as described in Technical Report EC-94/06 titled "Acoustic Analysis of Small Arms Fire," published in 1994. While it is known that individual gun blasts produce unique acoustic wave patterns, the military's research disclosed that within the frequency domain, most of the muzzle blast energy extends up to approximately 10 kHz. The Journal of the Audio Engineering Society's ENGINEERING REPORTS Vol. 63, No. 4, April 2015 titled "Gunshot Detection Systems in Civilian Law Enforcement" cited both of these military studies and specifically referenced the approximate 10 kHz frequency domain upper limit as well. The author of this report was Juan R. Aguilar, who is known and respected for conducting research on acoustic-based gunshot and sniper detection and localization, developing gunfire acoustic signature models and formulating acoustic signal processing algorithms. Another exemplary report having a frequency domain muzzle blast energy plot was published in a Physics Forum webpost. This reference teaches a precipitous linear decay after 10 kHz to background energy levels. These prior art references demonstrate that research and the resulting available information regarding muzzle blast energy as it pertains to the acoustic frequency consideration is directed to the normal hearing range of human hearing, below 20 kHz. Efforts to adapt AI to gunshot detection are limited by the available information.

In an effort to improve detection results, human analysis has been introduced into certain prior art systems. One example prior art system offered and currently known by the trademark ShotSpotter™ utilizes human judgement as a final classification arbiter. Other prior art systems have sought to augment the sound-based approach with the addition of other sensors. Examples include light or pressure sensors that seek to detect the muzzle flash or pressure sensors that seek to measure the overpressure associated with a gunshot, and then using the confluence of this sensor information to increase classification accuracy. While these systems provide an improvement in that they reduce false positives and false negatives, they also compound system requirements; for example, the muzzle flash must be observed in order to correlate the events or the overpressure must be measured and it has a very short range of useful measurement. And while such efforts have been shown to improve the reliability over AI or algometric/formulaic methodologies alone, the challenge is not fully met. Moreover, the introduction of human analysis increases cost and time required for classification. Also, system reliability becomes variable due to a reviewer's particular limitations—a person's innate hearing ability and their experience may impact correct classification of a given sound as a gunshot event. Generally speaking, prior art gunshot detection systems are expensive, require specialized skills for installation, have a complex setup, and/or require significant configuration or "tweaking" to meet a given performance level.

Thus, the prior art fails to disclose an autonomous gunshot detection system or method for detecting a gunshot event that utilizes the ultrasonic frequency distribution across a broad range of frequencies resulting from a muzzle blast to detect a gunshot event. The prior art further fails to disclose a gunshot detection system or method for detecting a gunshot event that utilizes a short burst of high-energy, wide-spectrum ultrasonic sound. The prior art further fails to disclose a gunshot detection system or method for detecting a gunshot event that addresses or reduces false positives and false negatives by analyzing a short high-energy, wide-spectrum ultrasonic burst of sound. The prior art further fails to disclose an autonomous gunshot detection system or method for detecting a gunshot event that utilizes the ultrasonic frequency distribution across a broad range of frequencies resulting from a muzzle blast for the purpose of distinguish an actual gunshot from other loud sounds. The prior art further fails to disclose an autonomous gunshot detection system or method for detecting a gunshot event that utilizes the wide-spectrum frequency distribution resulting from a gunshot event sound and its resulting decay to determine the location of a gunshot event.

SUMMARY

Systems and methods for detecting a gunshot event are disclosed. More particularly, systems and methods for detecting a gunshot event using the ultrasonic frequency distribution across a broad range of frequencies resulting from a gun's muzzle blast to determine whether an actual gunshot event has occurred and to minimize false positives and false negatives are disclosed. Yet further, systems and methods for determining the location of an actual gunshot event by utilizing the decay of the frequency distribution across a broad range of frequencies resulting from a gun's muzzle blast are disclosed.

All guns produce supersonic muzzle blasts (a shockwave) due to the pressure differential between the chamber pressure and the atmospheric pressure at the end of the barrel. More particularly, the muzzle blast of a gun produces an ultrasonic sound burst upon exiting the firearm and upon slowing to sonic speed. At that very instant, when the muzzle blast reaches its "Weber Radius" (approximately 0.4 meters from the gun), a short-duration, high-energy, wide-spectrum ultrasonic burst is the byproduct of this boundary-layer energy exchange within the atmosphere. Each gun's muzzle blast includes or produces a unique and identifiable acoustic signature that is characterized by a short-duration, high-energy, wide-spectrum ultrasonic burst, much of which is outside the range of human hearing. This type of ultrasonic event is measurably different from other sounds particularly when considering a wide spectrum of frequencies, including but not limited to ultrasonic sounds produced by a piezoelectric transducer, a magnetostrictive transducer, or by an electrodynamic action. This idiosyncrasy—the characteristic and unique ultrasonic noise burst produced by the gun muzzle blast shockwave as it transitions from supersonic to sonic propagation speed as the wave reaches its Weber Radius—may be used to determine if a given sound is an actual gunshot. The information contained within the burst allows for the proper detection and classification of gunshots. The disclosed embodiments utilize a gunshot's ultrasonic idiosyncrasies and in so doing facilitate gunshot detection. Some embodiments may further utilize the decay in this idiosyncratic noise burst to determine the location of the gunshot sound.

In one embodiment, sound information that includes the ultrasonic frequency range may be sampled, processed and stored. Some embodiments include sampling or collecting sound information, digitally extracting frequency energy distribution information across the full frequency spectrum (including ultrasonic data), processing the collected data to determine whether a given sound data comprises a gunshot and classifying a given sound data as a gunshot or otherwise. Further embodiments may include analyzing the sampled sound data over time and using the rate of decay to determine a location for the gunshot.

Sampling refers to how sound data is collected. In one embodiment, the system or method may sample continuously (or periodically) the audio sound frequency spectrum up to 200 kHz to search for a possible gunshot event that would be characterized by a short burst of high-energy, wide-spectrum ultrasonic sound. More particularly, the system or method may continuously or periodically monitor or listen for acoustic sounds that include a burst of sound having an ultrawide spectrum, including across the ultrasonic band from above 20 kHz to 200 kHz. An example sampling rate is 384 kHz or 384,000 samples per second. A preferred sampling rate is not limited to standard sampling at 44.1 kHz. For example, a microphone in one embodiment would preferably have the ability to reproduce the frequency content of a gunshot waveform, which is a complex analog waveform having components that range from 20 hz to well above 30 kHz, with a practical ultrasonic spectrum based upon distance and frequency decay of approximately 200 kHz. Other waveforms may be used.

Sampling also refers to the collection of representative data that may be used during teaching and classification. A bullet's position and a muzzle blast's position can be measured relative to time and distance from the point of firing of the weapon. A library of representative data can be created for weapons and ammunition that includes acoustic variables associated with the sound of a multiple subject guns and bullets. For example, recording stations can be set up at various angles and distances to obtain full sound spectrum information samples from a plethora of ammunition and weaponry. Each collected sample may have associated metadata recorded such as distance, angle, caliber, barrel length, azimuth, elevation and any other information deemed advisable for reliably capturing a gunshot's full sound spectrum. The resulting library of sounds may be further processed to obtain templates in the form of Spectrograms, where a typical representation for each combination is obtained. Spectrograms provide visual representations (a picture) of time, frequency, and intensity information of signals. The data visually displayed as Spectrograms is also conducive to both correlation and AI classification methods. Regardless of the methodology used by a particular embodiment, the ultrasonic burst may be included within the representative dataset for the classification step. Prior art systems do not capture this ultrasonic burst information, so they cannot leverage the information contained therein.

Processing refers to the processing of the collected and library data. There can be various requirements and steps of processing. For example, a first processing stage may include a multi-level gating analysis continuously run in real time against a digital gunshot sample to determine if a possible gunshot sound warrants further processing. At this stage, "the net may be cast widely" by performing, for example, a continuous high-level audio analysis looking for an ultrasonic sound burst. Such a first processing stage may be employed to promote signal processing efficiency, allowing for the reduction of unwarranted or unnecessary further and more costly processing. Some embodiments may further include a second processing stage. For example, if the result of the first processing stage yields a candidate gunshot sound burst, processing may further include a second processing stage which includes analysis of a waveform of the candidate gunshot sound burst and its data associated with a Spectrogram that includes ultrasonic frequency data to classify the candidate burst as a gunshot or otherwise. The person of ordinary skill will appreciate that the frequency information of the Spectrogram may be determined in a number of ways, including amongst others, utilizing a Fast Fourier Transformation analysis. Some embodiments may use analog to digital conversion technology (ADC) and mathematical processing such as Fast Fourier Transformations (FFT) instead of filters. For example, an embodiment may utilize FFT instead of bandpass filters to distinguish between events (e.g., gunshot vs. not a gunshot). A process of some embodiments essentially corresponds to computing the magnitude of the short-time Fourier transforms (STFT) of the signal. By calculating the frequency components of the signal over slices of time, separate pieces may be calculated and these windows may overlap in time and/or may be assembled or transformed.

Storing refers to storing raw sampling of audio data for gunshot and non-gunshot events and generated metadata. The audio data may then be compiled into a library that peripherals or "edge devices" can use to make gunshot/non-gunshot decisions, using gating, correlation, and machine learning (AI) methods that describe the ultrasonic acoustic signature of a gunshot. One embodiment may include a purpose-built device that utilizes a standard 110 Volt power supply. Additionally, in some embodiments, edge devices store and forward to a remote data center for processing and also as a final storage repository of raw samples of potential gunshot audio events. One or more embodiments may include gunshot recognition algorithm employing AI that may be accomplished here, further reducing the cost of the edge devices. The central repository may be used to further refine the processing library and algorithm to further enhance the overall system and its outcomes.

It is to therefore be understood that the present embodiments are not limited by connectivity, processing power, and storage capacity available on an edge device, and whether recognition is performed by the a local edge processor, or by sending raw sampled and collected audio waveform data to a remote processor and storage facility for analysis and recognition feedback as described above. Recognition algorithms may include simpler or more complex Signature Pattern Analysis and Correlation, Spectrogram Pixel Array Histogram Correlation, Spectrogram AI Model Edge Processing, or other methods, or combinations thereof depending upon engineering tradeoffs of processing power, storage capacity, response time performance, real-time connectivity, security, device dimensions, battery life, durability, and cost. Regardless of the method, current embodiments may include an analysis of the ultrasonic data and proper frequency domain analytics of the entirety of the waveform, looking for the tell-tale high-energy, wide-spectrum ultrasonic burst, the "acoustic signature" that distinguishes a gunshot from an otherwise loud noise.

It is to be further understood that the present disclosure includes determining a location of the gunshot event by analyzing the decay in frequency and the eccentricity of the measured sound with respect to frequency. Ultrasonic sound at the higher end of the spectrum decays more rapidly than sound within the normal human hearing range. Lower frequencies have a significant eccentricity due to the relative angle of the shooter with respect to the microphone. And given that ultrasonic soundwaves do not exhibit a significant attenuation due to these angle changes, these differences may be exploited to derive distance and angle from a gunshot's source. Therefore, the angle and distance is encoded within the gunshot's muzzle blast. When the initial muzzle blast reaches its Weber Radius, the moment when sound is produced, all of the ultrasonic frequencies are created having similar magnitude. Therefore, taking the intensity of several ultrasonic frequencies at a discrete location and applying the International Standard document ISO 9613-1:1993 Part 1 "Calculation of the absorption of sound by the atmosphere," and applying the formulas within section 6.2, allows for deriving the relative distance from sample taken to its point source. The preferred embodiment is able to derive distance using AI. Because the distance and angle information is encoded into the gunshot's muzzle blast upon its creation, by obtaining the AI sample data from all angles, distances, and with various guns, and using said samples to train the AI engine, the ability to determine distance is an inborn characteristic of the methodology used. It is also possible to create a library of gunshot data, essentially arrays of values of intensity, time, and frequency (spectrograms), and using correlation to determine the best match.

In another embodiment, the system or method may also be able to transmit gunshot detection event information directly from an edge device to a remote processing center or to a hive of other devices that might benefit from or utilize such information. Real-time communication over wireless communications such as 4G-LTE, 5G, Bluetooth, Wi-Fi, 900 Mhz, LTE-M, NB-IoT and other wired and wireless connectivity may all be used. Such transmissions could be relayed if deemed appropriate to a plethora of interested parties, including police officers; corrections staff; security guards, first responders and/or associated vehicles; churches; synagogues; mosques; schools; shopping malls; restaurants; retail stores; sports stadiums; smart cities and their associated devices; 911 Dispatch Centers; local video integration centers; Federal, State, and Regional emergency monitoring and alert centers; fire stations; emergency medical response centers; hospitals; national and local vendor security monitoring services; cloud and local server artificial intelligence-based security monitoring and management systems; centrally-monitored industrial, commercial, and/or residential video and security monitoring centers; standalone un-monitored home security systems; consumer smart speaker and connectivity devices such as Amazon Echo and Google Home and any number of other mobile and fixed location security data gathering and management solutions, may be provided with near real-time access to the resulting metadata produced by an embodiment.

It could also be useful for gunshot detection event information to automatically activate a camera or other gunshot detector device and broadcast an alert and/or a live audio stream to a local or remote monitoring system, or to other connected devices however accomplished. A silent alert or a live audio stream could allow other First Responders and/or Law Enforcement Command Staff to be notified of a possible active shooter situation and they could listen to a live audio stream of the event in real-time allowing for imp roved situational awareness and enhanced response capability.

Moreover, the real-time location of a wearable or a fixed location gunshot detection device could be displayed on a map. Such information could provide real-time situational awareness of the location of an active shooter upon gunshot detection where the map would automatically slew and zoom in to the location of interest and provide an audible alert tone. Similarly, some embodiments may have an embedded GPS receiver allowing real-time situational awareness of the location of the gunshot detection device and also nearby gunshot or active shooter events as they unfold. In a like manner, a detection device could include an emergency alert or "Panic Button" capability. A user could manually send a "Weapon Situation" alert before any shots were fired (or knife, ax, sword, club, baseball bat, bomb, vehicle, etc. were used as the weapon). The gunshot detection device embodiment could have alert capability, be able to take and upload photographs, and/or start live audio and/or video streaming that could be transmitted to a local and/or central monitoring system to provide a real-time situational awareness view of audio, visual, and location metadata in a location where a gunshot was identified. A gunshot detection device embodiment could serve as an individual component or combination microphone and edge processor, and as such may be able to locally identify gunshot events, and screen out false positives and/or false negatives. It may be advantageous for such gunshot detection devices to communicate with each other, and on a "Crowdsource" basis further confirm that a gunshot event has occurred. Such confirmation could collectively improve classification of a gunshot event. Thus, it is to be understood that the disclosed systems and methods may be used with, incorporated within, various other devices such as personal cameras, smartphones, broadcast media mobile news video cameras and audio recording devices, consumer-grade still and video cameras, audio recorders, home smart speaker and communications devices, and any other electronic mobile or fixed location devices where an acoustic but proximity constrained gunshot detection alert capability might be desired.

Devices constructed and methods practiced could also be implemented as a standalone, dedicated, fixed location gunshot detection device or sensor, in all the locations and types of entities already identified. An example of such a standalone embodiment would be a replacement for the standard wall power outlet plate, where one of the outlets is utilized for powering a gunshot detection device embodiment. The disclosed systems and methods may further be applied in a wide variety of existing types of fixed location sensor and "internet of things" (IoT) technology devices such as wired or wireless security cameras, security systems, perimeter security light and motion sensors, doorbells, thermostats, aircraft and train controllers and sensors, fire, smoke, and carbon monoxide alarms, kitchen appliances, industrial machinery controllers, electric and gas meters, electric distribution and substation transformers, high voltage transmission line sensors, pipeline pumping station controllers, traffic lights, street lights, toll booths, other smart cities devices, gasoline pumps, retail point of sale systems, and any number of other mobile and fixed location devices where having a gunshot detection capability might be desired. Disclosed devices and methods may also provide a highly reliable "Crowdsourced" network ability to quickly identify and more precisely report the location of a gunshot event.

A fixed or known device location of a device may be used to provide real-time situational awareness. For example, location information from device including an internal GPS sensor, or location information such as a known or assigned location such as Teacher X is assigned to Classroom 1 in School A, may be utilized to provide real-time situational awareness of approximately where in a school, office, or other facility one or more gunshots have occurred. So, by reference to a fixed or known location, the approximate real-time location of an active shooter could possibly be estimated.

Some personal cameras and other potential gunshot detection devices may be constructed so as to have local communications capabilities. Examples of such capabilities include Bluetooth and Wi-Fi real-time wireless communications. As a result, such devices could communicate in real-time. A false positive could be further identified (including confirmed or rejected as such) by real-time correlation and polling of other nearby gunshot detection devices.

Other devices and methods may be provided with policy-based processing logic that can automatically start video recording based upon combinations of events. Gunshot detection can be one such events. Such policies may include providing notifications, information and/or alerts to various parties.

For example, a gunshot detection device may transmit gunshot detection metadata or alerts or other information to a variety of devices including real-time situational awareness systems (such as the commercial product known as AVaiLWeb™). A disclosed embodiment could then make gunshot detection metadata available to First Responder and Resource Officer Dispatch Centers, University or School Administration workstations, Video Integration Centers, or used in association with web browser map-based views of a facility or area (e.g., a campus or business). Further, such gunshot detection metadata or alerts or other information may be transmitted to other gunshot detection devices, including wearables, vehicle mounted, or fixed location devices, within local proximity or within a designated GeoFence boundary. Similarly, a detection device or method may include a messaging capability for device owners to send text messages, including photographs and video clips to interested parties, for example, police officers and/or others may be somehow involved or affected by a detected gunshot event such as an active shooter.

As is discussed in greater detail below, the subject matter disclosed herein may be implemented as a computer-controlled apparatus, a method, a computing system, or as an article of manufacture including as a tangible, non-transitory computer-readable storage medium. These and various other features will be apparent from the following Detailed Description and the associated drawings.

This Summary is provided to exemplify concepts at a high level form that are further described below in the Detailed Description. This Summary is not intended to identify key or essential features of the claimed subject matter, nor is it intended that this Summary be used to limit the scope of the claimed subject matter. Furthermore, the claimed subject matter is not limited to implementations that address any or all disadvantages noted in any part of this disclosure.

BRIEF DESCRIPTION OF THE FIGURES

FIG. 2 through FIG. 6 are constructed in the same manner with the only variance being the selected timeframe used to calculate the FFT spectrum power plot.

FIG. 3 is an illustration, similar to FIG. 2, but in this case the selected timeframe of the FFT plot of the 9 mm gunshot has been shortened to 0.04 seconds and starts with the initial muzzle blast. The FFT plot shows more power is concentrated in the first half of the gunshot.

FIG. 4 is an illustration, similar to FIG. 2, but in this case the selected timeframe of the FFT plot of the 9 mm gunshot has been shortened to 0.03 seconds, roughly centered within the time domain plot. In this case the power does drop for all frequencies, but the higher frequencies are disproportionately attenuated compared to lower frequencies.

FIG. 5 is an illustration, similar to FIG. 2, but in this case the selected timeframe of the FFT plot of the 9 mm gunshot has been shortened to 0.04 seconds, selecting the tail end of the time domain plot. In this case the power does drop for all frequencies, but the higher ultrasonic frequencies are almost completely attenuated. The low frequency data is still well represented below 20 kHz.

FIG. 6 is an illustration, similar to FIG. 2, but the selected timeframe of the FFT plot of the 9 mm gunshot has been shortened to 0.0075 seconds and starts with the initial muzzle blast. Comparing FIG. 6 with FIG. 2, confirms that while there is no significant difference between these power plots for frequencies below 20 kHz, the ultrasonic intensity is significantly greater within this very short sliver of time, right at the initial impulse. FIG. 2 through FIG. 6 show that a spectrogram (as shown within FIG. 7) would provide a better means of graphically representing a gunshot's power spectrum as it varies with time.

FIG. 7 further shows a blue box that captures the short-duration, high-energy, wide-spectrum ultrasonic burst—a byproduct of a boundary-layer energy exchange caused when the supersonic muzzle blast of a gun slows to sonic speed after exiting the barrel. Within the blue box it is seen that lower frequencies have a higher concentration of white, the highest intensity shown within the plot, with very few pixels being white above the 100-kHz line. If measurement was made very close to the Weber radius, all captured frequencies would have a similar intensity. Therefore, the spectrogram of FIG. 7 shows that distance from the shots source is encoded within the decay of the higher frequencies.

DETAILED DESCRIPTION

Figure 1:
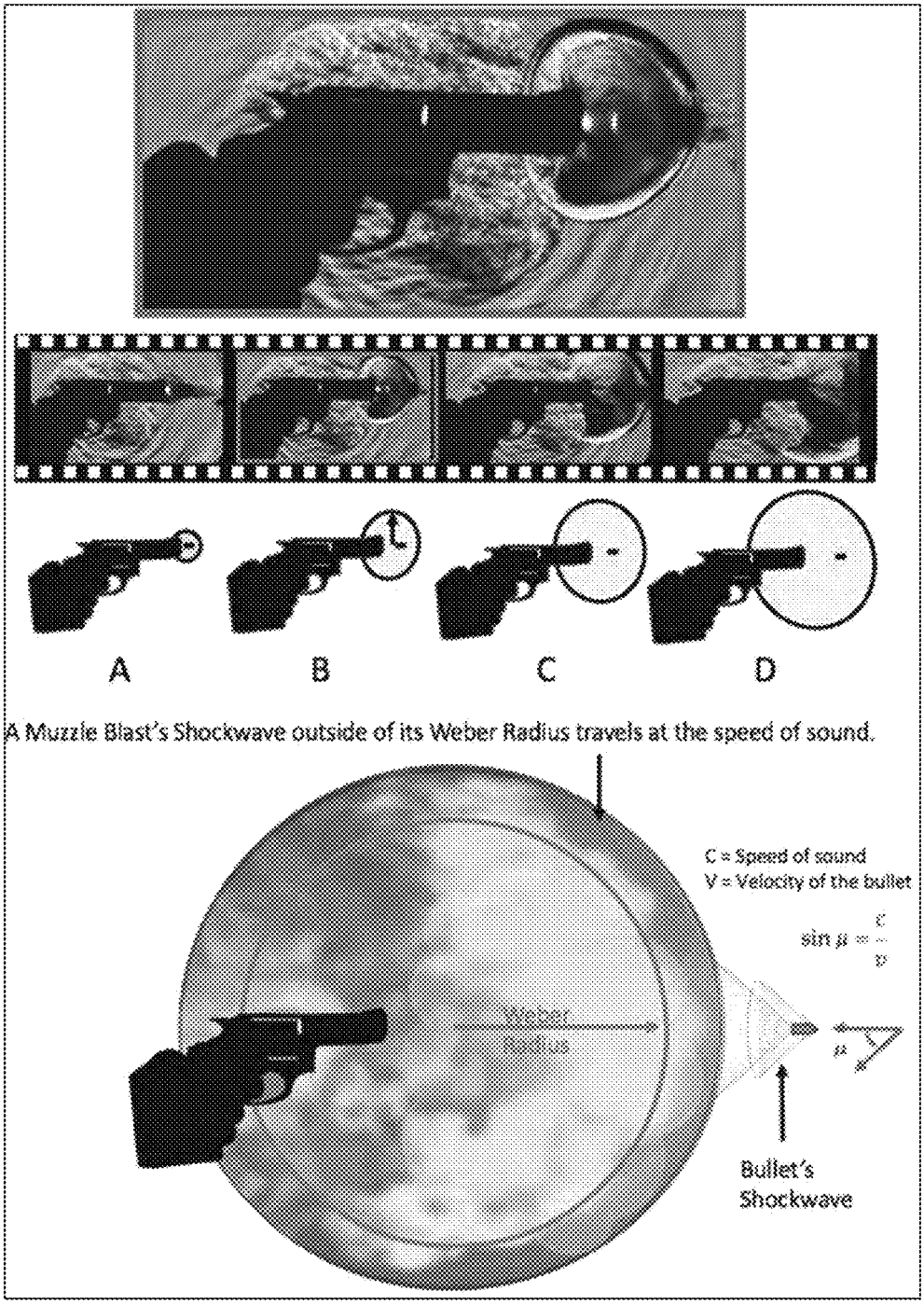
FIG. 1 is a diagrammatic illustration showing a muzzle blast from a revolver and the Weber Radius of its associated shockwave.

All guns produce supersonic muzzle blasts (a shockwave) due to the pressure differential between the chamber pressure and the atmospheric pressure at the end of the barrel. In contrast, fireworks and other types of black powder explosions are subsonic deflagration events, not detonations that produce a supersonic shockwave. While fireworks produce and are a loud noise event, they do not have the requisite geometry allowing for pressure to build within a confined space. The present embodiments recognize that muzzle blasts produce such a supersonic shockwave and utilize the characteristic ultrasonic noise produced by this shockwave as it transitions from supersonic to sonic propagation speed as the wave reaches its Weber Radius, and to distinguish a gunshot from other loud sounds that lack the unique characteristic of the gunshot muzzle blast, particularly in the ultrasonic frequency range.

The disclosed systems and methods detect and analyze a gunshot event in a manner that reduces and/or minimizes instances of false positives and false negatives. The disclosed systems and methods utilize the tell-tale acoustic signature of a gunshot resides in significant part within its ultrasonic spectrum; it is characterized as a very short-duration, high-energy, wide-spectrum ultrasonic burst (the idiosyncrasy) that cannot be heard by the human ears. This type of ultrasonic event is measurably different from ultrasonic sounds produced by a piezoelectric transducer, a magnetostrictive transducer, or by an electrodynamic action.

The muzzle blast of a gun produces the ultrasonic shockwave upon exiting the firearm. As that shockwave slows to sonic speed, at that very instant, the muzzle blast reaches its Weber Radius. For a handgun, the Weber Radius is reached at approximately 0.4 meters from the gun. The person of ordinary skill will appreciate that for different guns, ammunition, powder or other variables, the Weber Radius may be a somewhat of a somewhat greater or lesser dimension. Regardless, at that point, a short-duration, high-energy, wide-spectrum ultrasonic burst is the byproduct of this boundary-layer energy exchange within the atmosphere. The person of ordinary skill would further understand two documents to pertain to this effect, namely—ISO 9613-1 "Calculation of the absorption of sound by the atmosphere" and ISO 17201-2 "Estimation of muzzle blast and projectile sound by calculation." These documents focused on sound frequencies below 20 kHz, annoyance sounds, and therefore the charts provided and sound data disclosed were capped at 10 kHz, well within the human hearing range. However, the underlying formulas provided within these ISO documents allow for deriving a gunshot's frequency-dependent sound propagation characteristics within our atmosphere based upon Weber Radius calculations and the discussed model. These characteristics are recognized as applicable to the ultrasonic frequencies resulting from a muzzle blast as described above.

While scientific formulas predict the wide spectrum frequency content, accurately measuring such information also requires appropriate equipment. For example, processing sound data at ultrahigh sampling rates in accordance with the Nyquist-Shannon sampling theorem calls for equipment that is not limited to the Compact Disc standard sampling rate of 44,100 samples per second. Some embodiments therefore include custom-built circuitry that captures data up to 400,000 samples per second, resulting in ultrasound acoustic data capture up to 200 kHz.

It is to be understood that the very short-duration, high-energy, wide-spectrum ultrasonic burst is an idiosyncrasy of a gunshot sound. And it differs for different firearms and ammunition. The unique nature of this sounds burst is demonstrated in U.S. Pat. No. 3,202,087 (the '087 patent), which is directed to a nondestructive testing apparatus for pipe welds. More particularly, the '087 patent shows how difficult it is to generate high intensity, wide spectrum, ultrasonic waves in the first place. Piezoelectric transducers, magnetostrictive transducers, electrodynamic, and electrostatic methods all had limitation and were not capable of generating the requisite bursts. There were also no known mechanical means of generating such bursts. The '087 patent concludes that the solution to generate the required high intensity, wide spectrum, ultrasonic waves was to properly direct a gunshot into a resonance chamber within a coupling connected to the pipe. The gun used was a concrete anchor driver that may be purchased at a hardware store that utilizes a 22-caliber gun cartridge, minus the bullet. The muzzle blast was focused by the described coupling that induced the required high intensity, wide spectrum, ultrasonic waves into the subject pipe. While nondestructive pipe weld testing is not considered to be analogous to the current disclosure, this patent confirms that producing such a wide spectrum ultrasonic burst is a unique characteristic of a gun's muzzle blast. As described and claimed herein, the present systems and methods utilize that unique idiosyncrasy to detect whether a possible gunshot event is actually a gunshot or some other loud noise that may be confused with an actual gunshot.

In some embodiments, sounds that are candidate gunshots. For example, an embodiment may sample continuously (or periodically) the audio sound frequency spectrum up to 200 kHz. Mechanical collisions do not generate a burst of sound with the tell-tale gunshot sound burst including the ultrawide spectrum across the ultrasonic band from above 20 kHz to 200 kHz. Moreover, detecting and classifying such a burst as a gunshot event includes sampling, processing, and storing sound throughout the ultrasonic frequency range. As explained herein, the information contained within the ultrasonic burst allows for the proper detection and classification of gunshots. The disclosed embodiments make use of a gunshot's ultrasonic idiosyncrasies to accomplish gunshot recognition.

Sampling refers to how the sound data is collected. The microphone preferably has the ability to reproduce the frequency content of the sampled waveform. In application, a true gunshot produces a complex analog waveform having components that range from 20 hz to well above 30 kHz, having a practical ultrasonic spectrum based upon distance and frequency decay of approximately 200 kHz. In order to not lose the high-frequency content of the sampled analog waveform, it is desired that the analog-to-digital conversion (ADC), according to the Nyquist Theorem, provide a sampling rate of at least twice that of the component frequency sought to be captured digitally. The sampling rate may be twice $f_{max}$, the highest frequency component measured in Hertz for a given analog signal. When sampling is less than $2f_{max}$, the highest frequency components of the gunshot may be lost. Given bandwidth requirements, an ADC capable of sampling analog data at approximately 400 kHz is one appropriate sampling rate. To put this sampling rate in perspective, typical sampling rates of consumer quality acoustic systems are set to 44.1 kHz, often referred to as CD quality sound, since audio compact discs use the 44.1 kHz sampling rate.

Sampling also refers to the proper collection of representative data for later use in an embodiment during teaching and classification. For example, some embodiments that utilize Artificial Intelligence (AI) may depend on or use previously gathered data. For example, it is known that a gunshot's sound magnitude varies based upon angle from the shooter and other factors as described more fully in an article titled "Estimation of The Directivity Pattern of Muzzle Blasts" by Karl-Wilhelm Hirsch, Werner Bertels. Applying these factors, various samples of representative gunshot data may be harvested. In the Hirsch and Bertels article, samples were collected using an apparatus that encircled the shooter in 10 degree radials and at two discrete distances of 10 and 20 meters. While the Hirsch and Bertels' analysis was restricted to between 315 Hz and 10 kHz, within the human hearing range, the disclosed methodology provides useful information informing a proper sampling geometry for use in developing representative gunshot data for use in the present disclosure. Hirsch and Bertels plotted the eccentricity of the sound exposure level based upon angle from front to back of the shooter and determined that " . . . lower frequency components have a stronger directionality than higher frequencies. This is a special feature of muzzle blasts compared to other typical sound sources modeled as point sources." Hirsch and Bertels stated:

> "For a muzzle blast, the body of radiation is certainly not a sphere. Due to the basic rotational symmetry around the barrel axis, the radiating body still needs to be a body of revolution but estimating its shape and its radiation impedance is a rather challenge. The gases leaving the barrel with supersonic speed develop a so-called MACH-plate. The body of radiation will be wider to the front than looking from the rear giving reason for a strong frequency dependent directivity pattern."

There is a known method for visualizing shock waves. The method dates back three centuries to Robert Hooke's observations of the patterns generated by the sun's light as it passed through a candle's flame and the shadow it then produced upon the floor. This was later rediscovered by August Toepler, known today as the Schlieren method. This identical method was used by Weber and Mach to view a bullet's shockwaves in 1939. Recently however, an article published within the American Scientist, "High-speed Imaging of Shock Wave, Explosions and Gunshots", by Gary S. Settles, reveals shockwaves as never before seen. The shockwave is spherical and not an asymmetrical body or "Mach-plate" as described here by Hirsch and Bertels. The Penn State Gas Dynamics Lab has developed a method providing real-time visualization at full scale, with size and resolution far superior to the Schlieren method. Using this method, the lab has taken high-speed video showing a spherical muzzle blast being produced. The wavefront's shape is spherical. The molecular collisions and what precisely is happening at the nanoscale that gives rise to such a symmetrical shape having eccentricity in its energy and frequency distribution remain unexplained. This is perhaps best described as reproducible but a somewhat chaotic state that will never be modeled perfectly.

While the present system and methods do not depend or rely upon such modeling, these visualization techniques do allow for validation and for measurement of the bullet's position and the muzzle blast's position on a frame-by-frame basis. A gun's discharge is described to be a deflagration burn of the shell's propellant—a subsonic explosion that propels the bullet. It is very likely that such deflagration burns do transitions to a detonation burning for supersonic rifle rounds with exit velocities more than double the speed of sound and with muzzle blast shockwaves exceeding Mach 6.

Based upon the foregoing, the person of ordinary skill may appreciate that a library of representative gunshot data may be collected and used. For example, such a library may be used as an AI training set. To do so, many discrete samples of gunshots from different weapons firing different ammunition may be captured while varying the common acoustic variables associated with a gunshot's sound. Recording stations may be set at various angles and distances to obtain samples from a plethora of ammunition and weaponry. Each sample collected has its associated metadata recorded including: distance, angle, caliber, barrel length and any other information deemed advisable for reliably capturing a gunshot's full spectrum.

The resulting library of representative sounds may be processed to obtain templates in the form of Spectrograms, where a typical representation for each combination is obtained. Spectrograms provide visual representations of time, frequency, and intensity information of signals (a picture). The data visually displayed in the template Spectrograms is conducive to both correlation and AI classification methods of the present. Regardless of the methodology used by a particular embodiment, the disclosed systems and methods preferably contemplate that the aforementioned ultrasonic burst is included within the dataset for the classification step to yield an accurate result. Prior art systems have not captured such information, and therefore such systems are unable to leverage the information contained therein.

Processing refers to the processing of the collected and library data. There can be various requirements and steps. For example, in real-time, a multi-level gating analysis process may be continuously run against a digital sample to determine if a possible gunshot warrants advanced processing. Initially, "the net may be cast widely" by performing, for example, a continuous high-level audio analysis looking for a candidate impulse. This first gating analysis may be comprised of an amplitude test (e.g., is the captured sample signal loud enough that it could potentially be a gunshot), an ultrasonic test (e.g., does ultrasonic data exist in the captured sample such that it could potentially be a gunshot), or a wide spectrum correlation test (e.g., does frequency data correlate strongly enough with at least one known gunshot frequency response such that it could potentially be a gunshot). Other gating criteria may be employed. It's not necessarily important to be discriminating at this stage. This first gating step promotes signal processing efficiency, allowing for the reduction of unwarranted advanced, and more costly, processing.

If the result of this first processing stage yields a candidate sound, a system or method may apply a second processing stage, which may include an analysis of an audio waveform and the data associated with a Spectrogram that includes ultrasonic frequency data. The analysis may comprise different techniques, including gating, correlation and AI analysis. For example, additional gating may be employed directed to other as yet untested analytical points. Multiple gating inquiries may be used to further analyze the candidate sound and as answered by such filters, a determination of whether the candidate sound constitutes a gunshot. With reference to the correlation and AI methods, the frequency information of the Spectrogram may be determined in a number of ways, including amongst others, utilizing a Fast Fourier Transformation (FFT) analysis. While any of the known FFT algorithms may be used, the particularly described process essentially corresponds to computing the magnitude of the short-time Fourier transforms (STFT) of the signal. By calculating the frequency components of the signal over slices of time, separate pieces may be calculated and these windows may overlap in time and may be assembled or transformed. In any event, the systems and methods contemplate that the captured or sampled data is mathematically transformed to analysis. In one embodiment, a correlation function is used to determine whether the Spectrogram of the candidate sound corresponds to a known ultrasonic signature of a gunshot. The person of ordinary skill in the art may be aware of such correlation functions. By way of example, the Pearson correlation coefficient may be stated as a statistic that measures linear correlation between two signal variables X and Y. It has a value between +1 and −1, where 1 is total positive linear correlation (the signals are exactly the same), 0 is no linear correlation (the signals have nothing in common), and −1 is total negative linear correlation (one signal is the perfect inverse of the other). One expression for the subject formula to obtain the correlation coefficient between X and Y is:

$$\frac{\mathrm{cov}(X, Y)}{\mathrm{std}(X)\mathrm{std}(Y)},$$

where cov is covariance and std is standard deviation

Applying an appropriate correlation function in the disclosed analysis of a Spectrogram of a candidate gunshot sound, determining whether said candidate sound is a gunshot utilizes such a correlation function to determine whether that Spectrogram corresponds to a known ultrasonic signature of a gunshot as shown in the library.

A person of ordinary skill in the art will appreciate that Artificial Intelligence (AI) differs from correlation. Stated more succinctly, AI is not correlation. AI builds a specific, custom function to apply to inputs and generate an output (this is often referred to as the model). In its simplest form, the function may take the form of A+B(s0)+C(s1)+D(s2) . . . +N(sn), where sn is the value of the sample at the n position. The values of A through N are initially unknown. One builds the function by feeding many signals, along with their known outputs, (the ground truth) into an algorithm that will adjust the values of A through N repeatedly until an acceptable formula exists (a formula that produces the correct output at a satisfactory rate). In an AI embodiment, a determination regarding the candidate gunshot sound utilizes artificial intelligence to determine whether the candidate sound Spectrogram corresponds to the know ultrasonic signature of a gunshot.

Storing refers to storing raw sampling of audio data for gunshot and for non-gunshot audio events during the collection phase. Those data are then compiled into a library that edge devices can quickly use to make fast and efficient gunshot/non-gunshot decisions, using the gating, correlation, and machine learning methods mentioned above that describe the "signature" of a gunshot. Additionally, in one of the preferred embodiments, edge devices store and forward to a remote data center for further processing and also as a final repository of raw samples of potential gunshot audio events. Gunshot recognition algorithm embodiments including AI may be accomplished here where the computing horsepower is sufficient, further reducing the cost of the edge devices as these may be deployed by the millions. The central repository may then then used to further refine the processing library and algorithm to further enhance the overall system and its outcomes.

The systems and methods may be expressed in different embodiments depending upon the connectivity, processing power, and storage capacity available on the edge gunshot detection device, and whether recognition is performed by the gunshot detection device as a local edge processor, or by sending raw audio waveform data to a remote processor and storage for analysis and recognition feedback as described above. Recognition algorithm embodiments could include simpler or more complex Signature Pattern Analysis and Correlation, Spectrogram Pixel Array Histogram Correlation, Spectrogram AI Model Edge Processing, other methods, or combinations thereof depending upon engineering tradeoffs of processing power, storage capacity, response time performance, real-time connectivity, security, device dimensions, battery life, durability, and cost.

One embodiment uses ADC and mathematical processing such as FFT transformations instead of filters. For example, a preferred disclosed embodiment does not require the use of bandpass filters to distinguish between events (e.g., gunshot vs. not a gunshot). The person of ordinary skill in the art may appreciate that mathematically transforming the signal data utilizing a Fast Fourier Transformation may be accomplished using any of the family of known FFT algorithms including but not limited to the following: Cooley-Tukey FFT algorithm, Prime-factor FFT algorithm, Bruun's FFT algorithm, Rader's FFT algorithm, Bluestein's FFT algorithm, Goertzel algorithm. Further, the person or ordinary skill in the art will appreciate that mathematically transforming the signal data utilizing or calculating a Fast Fourier Transformation may be accomplished using any of the family of known FFT implementations including but not limited to the following: ALGLIB, FFTW, FFTS, FFTPACK, Math Kernel Library, cuFFT.

One embodiment may also be able to transmit gunshot detection events directly from an edge gunshot detection device to a remote processing center or locally to the hive of other devices that might benefit from its information. Real-time communication over wireless communications such as 4G-LTE, 5G, Bluetooth, Wi-Fi, 900 Mhz, LTE-M, NB-IoT and other wired and wireless connectivity are all contemplated for transmission of data. Such transmissions could be relayed if deemed appropriate to police officers, corrections staff, security guards, first responders and/or associated vehicles, churches, synagogues, mosques, schools, shopping malls, restaurants, retail stores, sports stadiums, smart cities and their associated devices. Ultimately 911 Dispatch Centers, local video integration centers, Federal, State, and Regional emergency monitoring and alert centers; fire stations; emergency medical response centers; hospitals; national and local vendor security monitoring services; cloud and local server artificial intelligence-based security monitoring and management systems; centrally-monitored industrial, commercial, and/or residential video and security monitoring centers; standalone un-monitored home security systems; consumer smart speaker and connectivity devices such as Amazon Echo and Google Home, and any number of other mobile and fixed location security data gathering and management solutions, may be provided with near real-time access to the resulting metadata.

In some embodiments there may also be geographical areas designated where a user would not want a gunshot detection device to record or report a gunshot. One example is a Police department may not want a gunshot detector, recording or other device to report a gunshot detection event from within a gun practice range. And similarly, an entity may only want gunshot detection to operate within a specified time period, such as a designated date, day of week, and time range or an enterprise may want users to have the option to place the gunshot detector into a manually selected "Off-Duty" mode that would ignore all possible gunshot events. This could be useful for police training at gun ranges where the officer is wearing a device that performs the gunshot detection device functionality on their person or has an edge detection device mounted on their police vehicle. Thus, a preferred embodiment would accommodate such policy-based requests.

It could also be useful for gunshot detection events to automatically activate a camera or another gunshot detection device and broadcast an alert and/or a live audio stream to a local or remote monitoring system, or to other connected devices however accomplished. A silent alert or a live audio stream could allow other first responders and/or law enforcement to be notified of a possible active shooter situation and they could listen to a live audio stream of the event in real-time allowing for imp roved situational awareness and enhanced response capability.

Moreover, the real-time location of a wearable or a fixed location device could be displayed on an electronic map. This information could also provide real-time situational awareness of the location of an active shooter upon gunshot detection where the map would automatically slew and zoom in to the location of interest and provide an audible alert tone. Similarly, a preferred embodiment may have an embedded GPS receiver allowing real-time situational awareness of the location of the device and also nearby gunshot or active shooter events as they unfold. In a like manner, an embodiment of a gunshot detection device or method could include an emergency alert or "Panic Button" capability. One could manually send a "Weapon Situation" alert before any shots were fired (or knife, ax, sword, club, baseball bat, bomb, vehicle, etc. were used as the weapon). As yet another example, a gunshot detection device could have alert sounding capability, or be able to take and upload photographs, and/or start live audio and/or video streaming to a local and/or central monitoring system to provide a real-time situational awareness view of audio, visual, and location metadata in a location where a gunshot was identified.

An embodiment of a gunshot detection device or method could further serve as an individual component or combination microphone and edge processor, and as such may be able to locally identify gunshot events, and screen out False Positives. It would be advantageous for nearby Gunshot Detector devices to communicate with each other, and on a "Crowdsource" basis further confirm that a gunshot event has occurred. Such confirmation could thus collectively improve classification. When seconds can mean the difference between life and death in an active-shooter situation, any time delay having the sound recording being placed into a review wait queue, and/or waiting some amount of time for a next available human analyst to listen to, classify, and report a possible gunshot event, should be avoided to the maximum extent possible. Therefore, a gunshot detection system that requires remote human confirmation will cause delay and thus further delay an appropriate response (or even fail) when it was needed most.

Another embodiment allows for relatively inexpensive purpose-built acoustic hardware to be paired with devices that have innate computational capabilities, but may lack the required sampling rate to capture the ultrasonic audio, such as smartphones. Thus, it is to be understood that the disclosed systems and methods may be used with, incorporated within, mobile video and audio recording devices such as personal cameras, smartphones, broadcast media mobile news video cameras and audio recording devices, consumer-grade still and video cameras, audio recorders, smart speakers, and any other electronic fixed or mobile devices where an acoustic but proximity constrained gunshot detection alert capability might be desired. As discussed above, prior art attempts at gunshot detection have used smartphones to detect candidate gunshot sounds. Embodiments preferably support sound sampling rates sufficient to obtain ultrasonic data. In the alternative, an unmodified smartphone or similar computing platform may overcome any innate limitations by having a secondary device paired with or directly connected to the platform that incorporates the teaching.

FBI statistics between 1988 and 2003 show that 93% of the time, the distance between a shooter and a police officer killed by a gunshot occurred at distance of 50 feet or less. NYPD data from 1854 to 1979 shows that 90% of officers were killed within 15 feet from the shooter. For gunshot events between 1970 and 1979 where NYPD officers survived, the shooting distance in 75% of cases was less than 20 feet. Anecdotal reports from several recent school, church, mosque, and synagogue multiple gunshot events indicate they generally occurred after a gunman entered into a classroom, sanctuary, or hallway of relatively small dimensions. The disclosed systems and methods thus contemplate embodiments having a somewhat limited effective distance of up to 200 meters more than adequately address the majority of the scenarios found in practice.

Figure 9A:
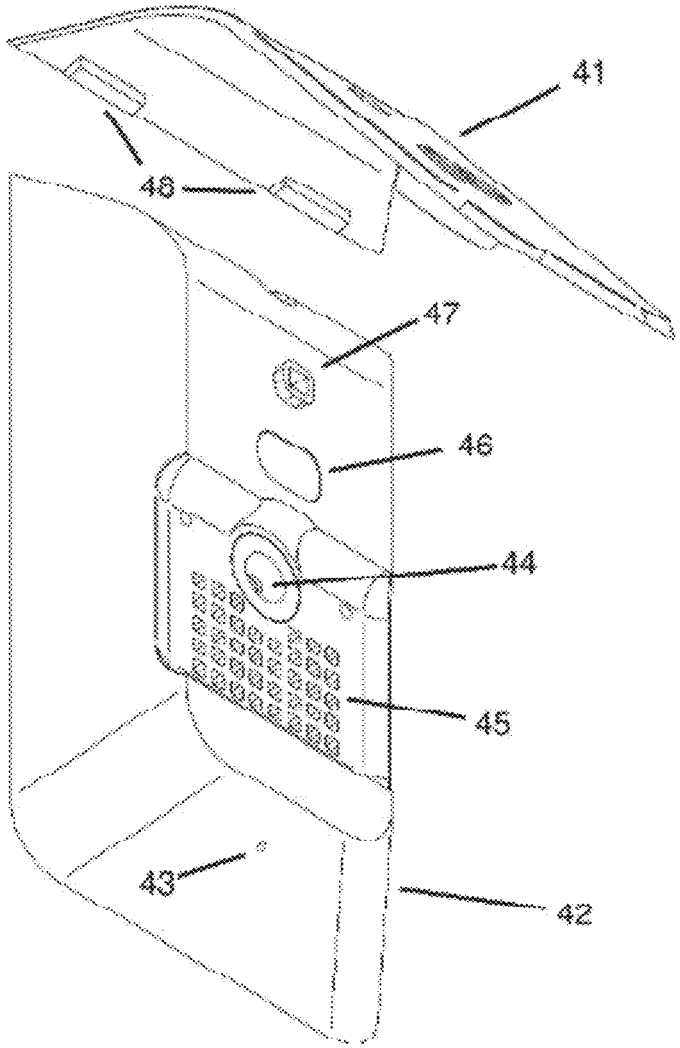
FIGS. 9(*a*)-(*c*) are three perspective views of a purpose-built device in accordance with an embodiment of the present disclosure.
Figure 9B:
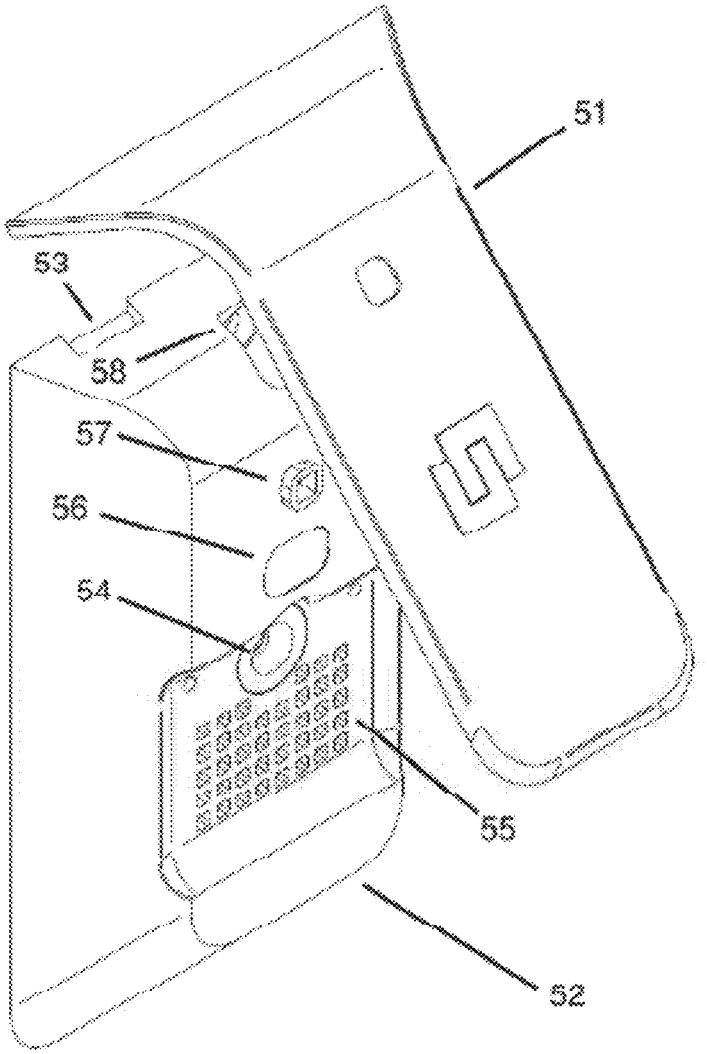
Figure 9C:
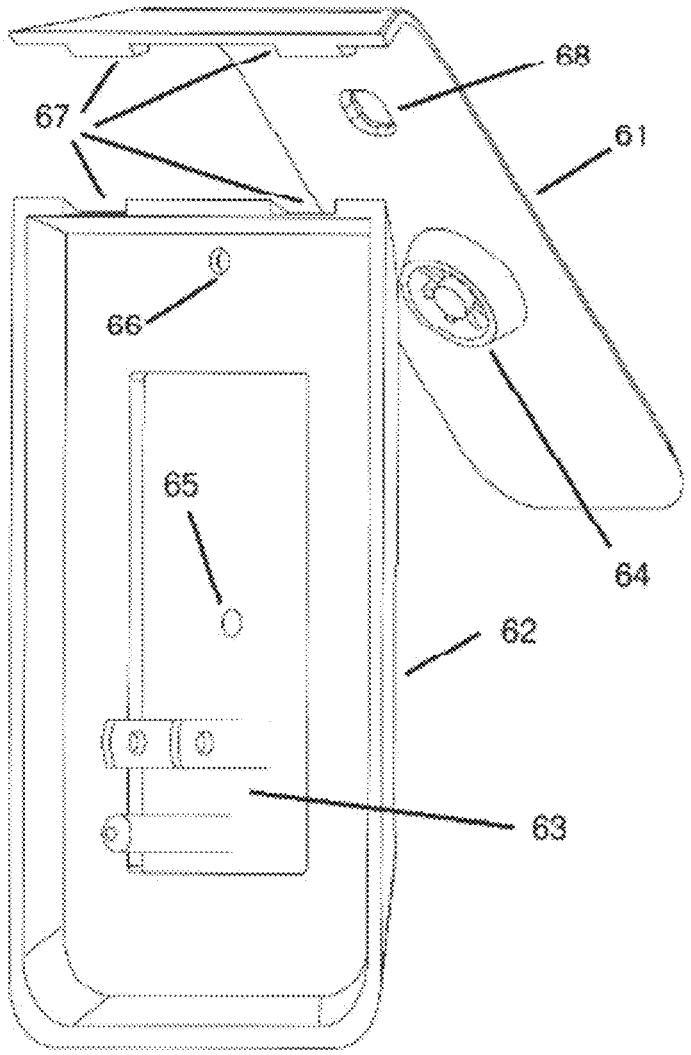

The disclosed systems and methods could also be implemented as a standalone, dedicated, fixed location gunshot detection sensor, in all the locations and types of entities already identified. An example of such standalone embodiment would be a replacement for the standard wall power outlet plate, where one of the outlets is utilized for powering the gunshot detection device. Representative embodiments are shown in FIGS. 9(*a*)-(*c*) herein which show purpose-built devices that may include known components and features such as a suitable microphone, an analog to digital converter, a microprocessor, a communications chip, WIFI, a transmitter, memory and storage. FIG. 9(*a*) shows an embodiment of a detection device with a cover plate 41 with a pair of tabs 48 for securing the cover plate to a cooperating housing 42. The housing 42 contains the electronic components disclosed embodiment. It will be understood by the person of ordinary skill that the necessary electrical components reside within the housing 42 and behind the cover plate 41 when the cover plate is in a closed position against the housing. The device of FIG. 9(*a*) further includes a port 43 for receipt of a microphone that is capable of sampling the broad range of frequencies suitable for practice of the disclosed embodiments. The embodiment shown in this Figure further shows a hole 44 for receipt of a security screw, a port 45 for receipt of a speaker and a port 47 for a second microphone suitable for practice of the disclosed embodiments. The device shown in FIG. 9(*a*) further includes an activation button 46.

FIG. 9(*b*) shows a detection device with a with a cover plate 51 and a cooperating housing 52 for containing electronic components necessary for operation of disclosed embodiments. The device of FIG. 9(*b*) includes a receptacle 53 for cover plate locking tabs, a hole 54 for receipt of a security screw and another hole 58 for receipt of a top security screw suitable for use with a standard 110 volt alternating current outlet. The embodiment shown in FIG. 9(*b*) further includes an acoustic port 55 for receipt of a speaker and an acoustic port 57 for receipt of a microphone suitable for practice of the disclosed embodiments. The device shown in FIG. 9(*a*) further includes an activation button 56.

FIG. 9(*c*) shows a detection device with a with a cover plate 61, a cooperating housing 62 for containing electronic components necessary for operation of disclosed embodiments and a lock 64 feature for the top housing. The device of FIG. 9(*c*) includes a standard 110 volt AC plug 63, a hole 65 for receipt of a security screw, a hole 66 for receipt of a top security screw and tabs 67 to lock the cover plate in position on or over the housing. The embodiment shown in FIG. 9(*c*) further includes an acoustic port 68 for receipt of a microphone suitable for practice of the disclosed embodiments.

In these implementations, a security screw may be utilized for the plate to be securely and easily mounted at a wall socket. The disclosed systems and methods may further be applied in a wide variety of existing types of fixed location sensor and "internet of things" (IoT) technology devices such as wired or wireless security cameras, security systems, perimeter security light and motion sensors, smart speakers, doorbells, thermostats, aircraft and train controllers and sensors, fire, smoke, and carbon monoxide alarms, kitchen appliances, industrial machinery controllers, electric and gas meters, electric distribution and substation transformers, high voltage transmission line sensors, pipeline pumping station controllers, traffic lights, street lights, toll booths, other smart cities devices, gasoline pumps, retail point of sale systems, and any number of other mobile and fixed location devices where having a gunshot detection capability might be desired. Devices and methods can also provide a highly reliable "crowdsourced" network ability to quickly identify and more precisely report the location of a gunshot event.

The person of ordinary skill may appreciate that a fixed or known gunshot detection device location may be used to provide real-time situational awareness. For example, location information from such a device including an internal GPS sensor, or location information such as a known or assigned location such as Teacher X is assigned to Classroom 1 in School A, may be utilized to provide real-time situational awareness of approximately where in a school, office, or other facility one or more gunshots have occurred. So, by reference to a fixed or known location, the approximate real-time location of an active shooter can be estimated with significant reliability. Relatedly, a personal camera or other potential gunshot detection devices may be constructed so as to have local communications capabilities. Examples of such capabilities may include Bluetooth and Wi-Fi real-time wireless communications. As a result, such devices could communicate in real-time and be utilized to further address reliable detection of a possible gunshot event. For example, a false positive could be further identified (including confirmed or rejected as such) by real-time correlation and polling of other nearby detection devices.

The disclosed systems and methods further contemplate having policy-based processing logic that can automatically start video recording based upon combinations of events. Gunshot detection can be one of these policy-based video recording start events. In many cases a video recording start from any combination of policy-based events causes pre-event video to be pre-pended to the camera's video segment. In the case of a gunshot event, the policy-based recording engine determines whether to pre-pend video and/or audio to video being stored and/or transmitted. In addition, a personal camera or data recording device or apps captures GPS, accelerometer, gyroscope, and other metadata that may be embedded in the video file and/or stored once a gunshot has been detected. A gunshot detection device and method may also generate and transmit gunshot detection sound wave data, metadata, and alerts to persons that may appropriately utilize such information. For example, gunshot detection metadata and alerts from one or more preferred gunshot detection devices can then be transmitted to real-time situational awareness systems (such as the commercial product known as AVaiLWeb™). The disclosed systems and methods could then make gunshot detection metadata available to first responders and others or used in association with web browser map-based views of a facility or area (e.g., a campus or business). Such real-time situational awareness views and alerts may be provided to smartphones, tablets, laptops, computer monitors, Police Computer Aided Dispatch and Video Integration Center monitors, and other web-browser capable display systems.

Further, the disclosed systems and methods include that gunshot detection metadata and alerts may be transmitted to other gunshot detection devices, including wearables, vehicle mounted, or fixed location devices, within local proximity or within a designated GeoFence boundary. Some or all gunshot detection devices could receive emergency alert messages with audio alerts, text messages, active shooter information (e.g., photographs, video clips, classroom or office lockdown instructions, etc.). A gunshot detection device may further provide on-going alerts, status messages, and all-clear messages to teachers, supervisors, or other personnel who have a gunshot detection device.

In view thereof, one embodiment of the present includes a method for accurately determining the occurrence of a gunshot by utilizing the ultrasonic spectrum. Such method may include three steps:

a) Capturing a digital audio signal with such fidelity that the constituent frequencies that comprise ultrasonic frequencies are retained and preserved;
b) Mathematically transforming the captured data by creating a spectrum of frequencies of the signal as it varies with time (spectrogram);
c) Determining whether the spectrogram or sampled portions thereof contains the characteristic short-duration, high-energy, wide-spectrum, ultrasonic burst, that corresponds to the discovered unique ultrasonic signature of a Gunshot.

Figure 10:
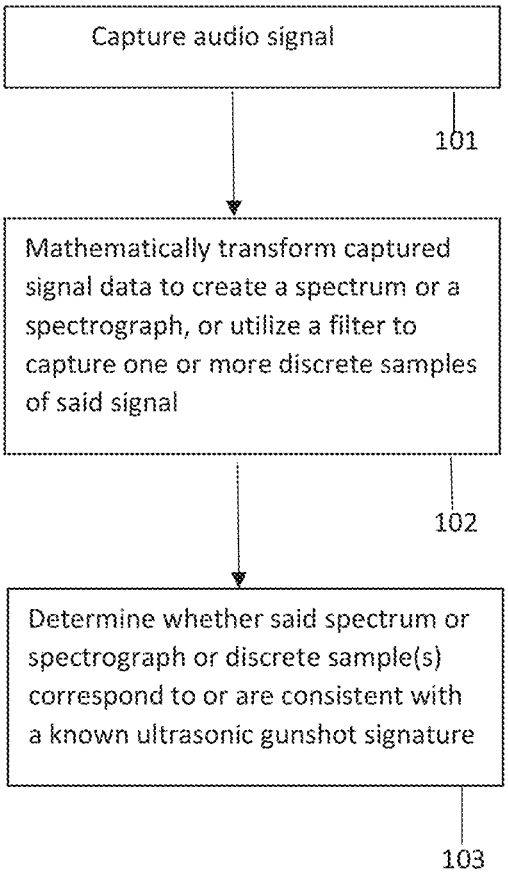
FIG. 10 is a diagrammatic flowchart of an embodiment of the present disclosure.

These steps are reflected in the chart provided in FIG. 10. In an implementation, the audio signal is preferably captured (or sampled) with such fidelity that the constituent ultrasonic frequencies are also retained and preserved. Obtaining the characteristic short-duration, high-energy, wide-spectrum, ultrasonic burst, that corresponds to a discovered unique ultrasonic signature of a gunshot may be otherwise lost. Thus, prior art teaching that using "reference equipment" (i.e.: studio, monitor, or reference audio equipment) is acceptable for the capture of a gunshot's sound fails to capture key information. Such systems are purpose-built for the reproduction of sound geared specifically for music playback in the 20-20 kHz range. In order to satisfy the Nyquist-Shannon sampling theorem over this band of interest, attenuating some of the in-band signal is acceptable (an anti-aliasing filter). Applying a low-pass or other such filtering mechanism removes the high frequency content. Once such content is removed in this manner, the information is lost. While such an approach may make the captured sound more pleasant for human listening, it removes the important signal content required for classification.

The disclosed systems and methods contemplate that the electrical design may avoid or appropriately address audio signal overload. A loud noise in close proximity to a microphone may give rise to a signal that would cause clipping at the analog-to-digital converter. If the resulting signal is clipped, phantom components outside the passband of the anti-aliasing filter will result; these components will then likely alias and will cause non-harmonically related frequencies to be produced. The disclosed systems and methods preferably capture an audio signal with such fidelity that the constituent frequencies that comprise its ultrasonic frequencies are "real" and not an aberration or phantom signal content.

Figure 8:
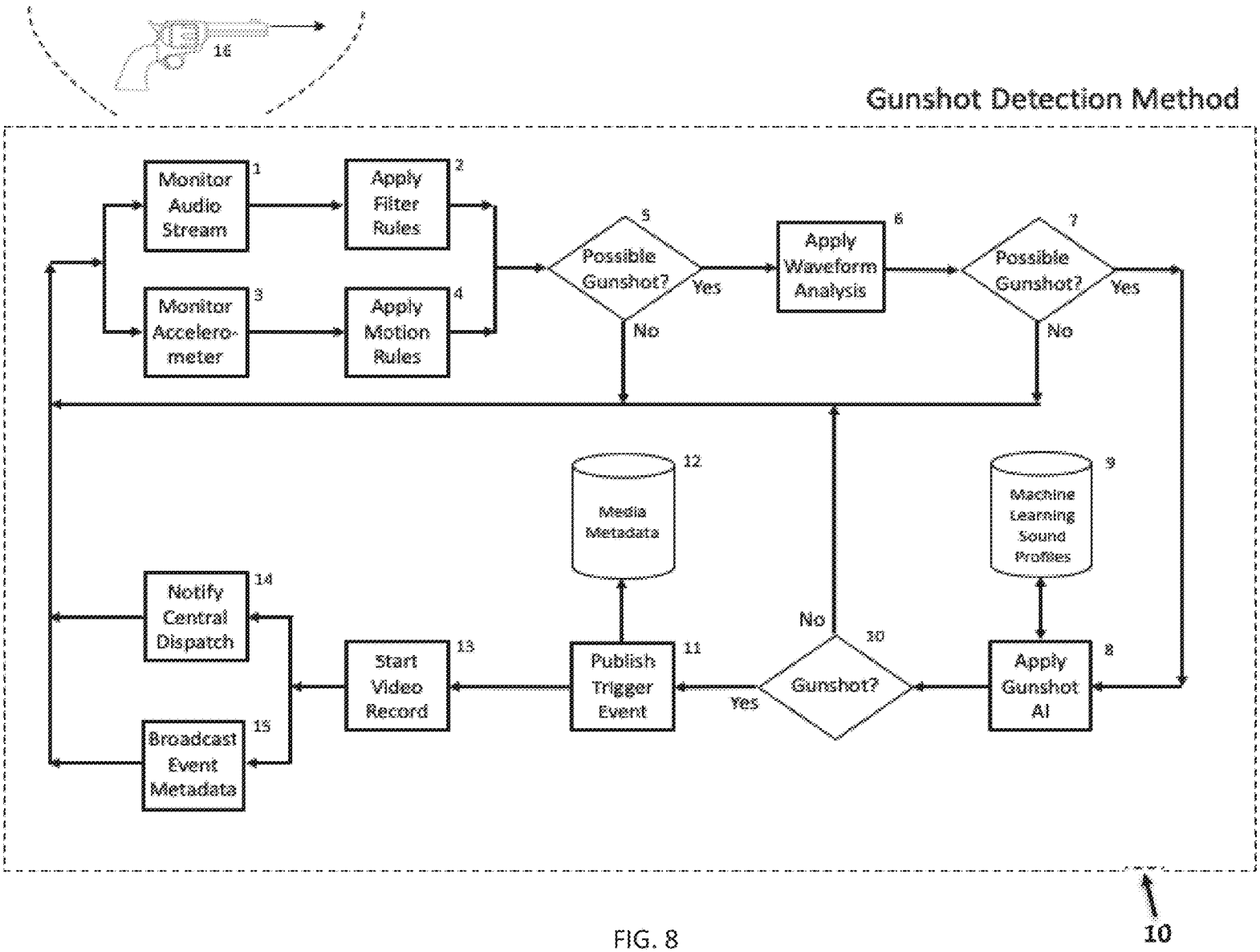
FIG. 8 is a schematic view of a system and method of gunshot detection according to an embodiment of the present disclosure.

FIG. 8 shows an embodiment for detecting a gunshot in steps 1-15. Referring in more detail to FIG. 8, a diagrammatic view of a disclosed embodiment shown generally at 10, the embodiment includes monitoring for audio input at 1 that may capture sound comprising a gunshot emanating from a gun 16. More specifically, this disclosed embodiment includes apparatus that monitors or constantly scans for audio signals that may include the sound of a gunshot event. Ultrasonic sensors, such as microphones capable of sampling, are appropriate for use to provide for "monitoring audio stream" at 1. This embodiment further includes applying a filter at 2 to filter out sounds are decidedly not gunshot events, such as background noise, at 5. Higher level filters can be applied to identify possible gunshot like sounds, including an initial analysis of the waveform at 6. The person of ordinary skill will appreciate that such an operation utilizes an analog to digital converting device for converting analog sound waves into electrical signals (or digital information) that may then be amplified or recorded. It will be appreciated that such an evaluation will include a review of frequency information in the ultrasonic range, which is expressly to include information gathered that is between 20 KHz and as great as 200 KHz. An embodiment may also include a filter that applies rules to isolate possible gunshot sounds. Such rules are known to the person of ordinary skill in art. Once the waveform processing is completed at 6 and a candidate gunshot event is determined 7, and AI based determination may be made at 8 using machine learning profile data such as that in the library 9 in accordance with this embodiment. Regardless of whether the candidate event is determined to be a gunshot or not, the data may be added to the library for further AI training and reference. Applying an AI analysis, a classification of the candidate event as either a gunshot or not a gunshot is made at 10. Assuming that classification is a gunshot, such information may be published at 11 and other operations may be initiated such as starting a video recording device 13, notifying a central police or other first responder dispatch 14 and transmitting metadata of the event for use by the dispatched persons or otherwise 15. To the extent possible, further metadata such as distance from the microphone and gun type and caliber may be determined by Spectrogram Signature Pattern Analysis and Correlation, Pixel Array Histogram Correlation, AI Model edge processing, or other means. Once a gunshot event 10 is confirmed, gunshot metadata is published 11 to a metadata repository 12 for audit trail and chain of custody reporting. In the case of a personal camera, video recording 13 is started. Gunshot detection event notifications 14 are sent to Central Dispatch and any other predetermined authorized metadata recipients. To the extent possible, video, audio, and metadata may be lived streamed to authorized recipients. In this example embodiment, the sampling rate is shown to be 384,000 times per second. The sampling processes digital output is available for analysis and processing such as a Fast Fourier Transformation to generate a Spectrogram, spectrum or other frequency-based method of analysis.

Figure 7:
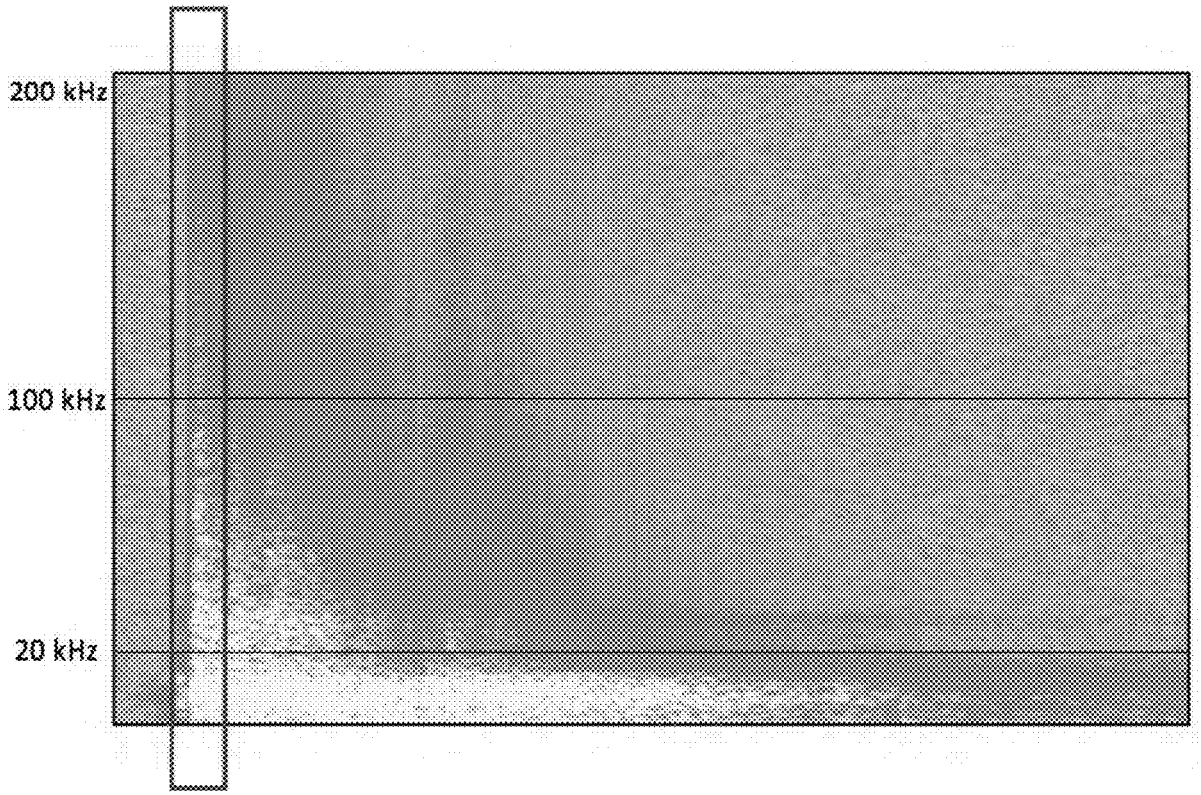
FIG. 7 shows a spectrogram for the sound waveform of a 9 mm gunshot. This transformation of the sound waveform plots the Frequency on the Y-axis and Time on the X-axis and the waveform's intensity is now plotted by its color. The colors vary from low background intensity shown as light blue, then to pink, purple, red, and finally on to white, with white being the highest intensity level measured. Spectrogram pictures may be used for training AI and for AI classification methodologies in accordance with some embodiments.

FIG. 7 shows a Spectrogram according to the present disclosure. More particularly, FIG. 7 shows that the ultrasonic content of a sampled gunshot sound continues beyond or exceeds 192 kHz. Given the measured rate of ultrasonic frequency decay on the high end of the spectrum with distance from the source, sampling for frequencies above 192 kHz is not necessarily worth the cost. A sampling rate of 384 kHz is currently used by the preferred embodiment of the current allowing for the constituent ultrasonic frequencies up to 192 kHz to be retained and preserved in their entirety. Sampling at this rate is almost ten times that required for CD quality sound systems. Sampling at a lower rate will not allow for the entirety of the spectrum of the ultrasonic burst to be properly captured. In addition to the sampling rate, the fidelity of the measured sample is also important. Measurements of 12 or 16-bit resolution are appropriate.

It is to be understood that FIGS. 2-6 show graphs of gunshot muzzle blast in accordance with FIG. 1. With reference to the drawings, it may be appreciated that digital audio signal is a sampling of air compression due to sound waves. In one embodiment, such a sampling requires a microphone, typically ceramic, that is capable of and designed for sampling ultrasonic waveforms and producing an analog representation of such waveform. This can be represented as a two-dimensional plot (time on the "x" axis and relative amplitude on the "y" axis, as shown in upper portions of FIGS. 2, 3, 4, and 6). A digital audio spectrum is a representation of audio frequencies present in a digital audio signal obtained by converting an analog sourced to digital information and then obtaining its spectrum using a formula such as an FFT formula. This identifies which frequencies are present in a digital audio signal and relatively how powerful each frequency is in that signal. This can be represented as a two dimensional plot (frequency on the "x" axis and relative power on the "y" axis, as shown in lower parts of FIGS. 2, 3, 4, and 6). Further, a digital audio spectrogram is a set of spectrums. A spectrogram is obtained by obtaining multiple spectrums over a period of time. The spectrogram is each spectrum, one after the other. This lets one know, for a digital audio signal, which frequencies are present at what power and when. This can be represented as a three dimensional plot (time on x axis, frequency on y axis, and relative power on z axis—often represented as color or gray scale variations) (FIG. 7).

Figure 2:
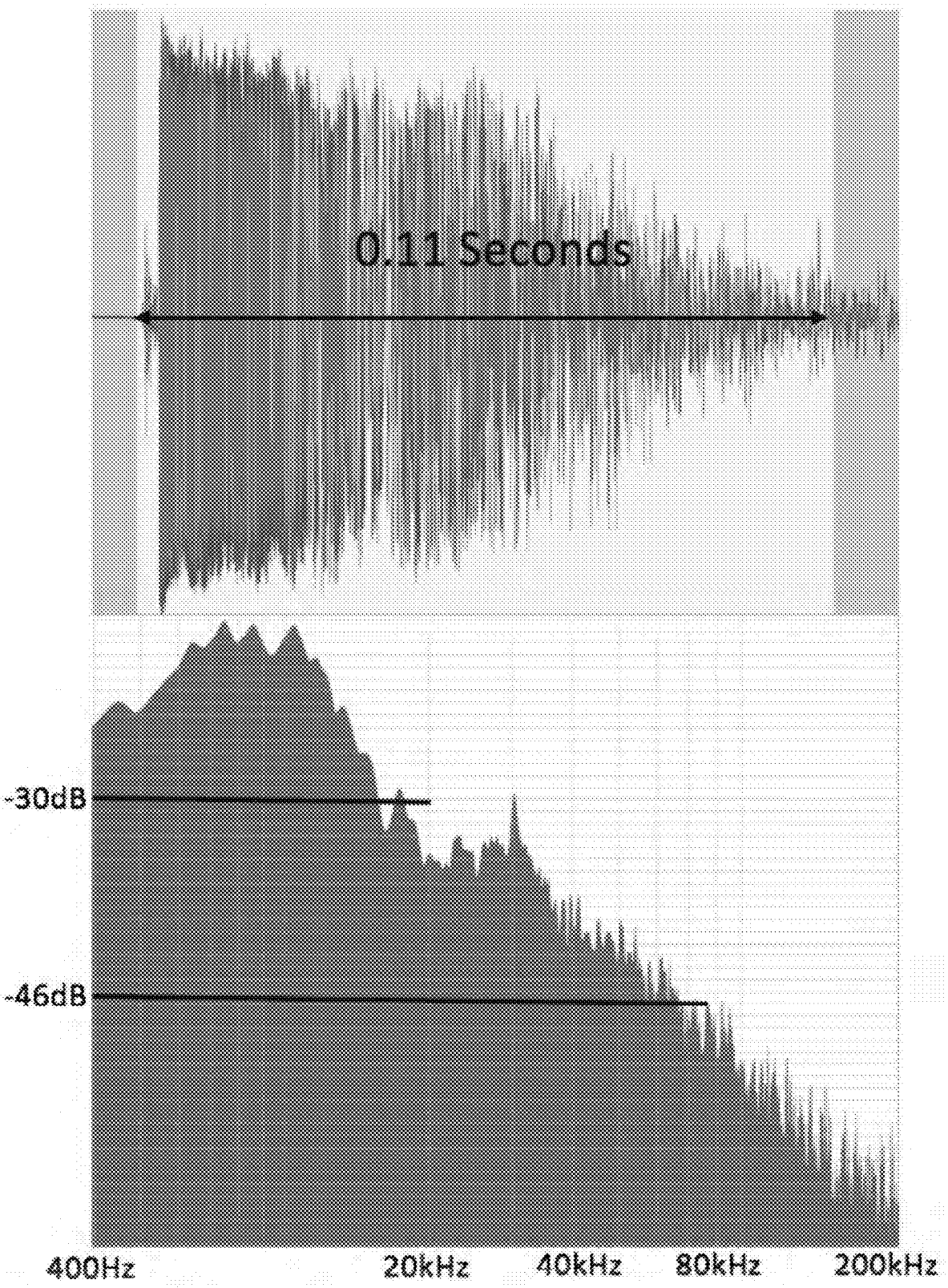
FIG. 2 is an illustration graphically showing the sound waveform of a 9 mm gunshot in an upper graph and its associated power spectrum in a lower graph. The upper graph is a time domain raw sound plot with the x axis being time and the y axis representing the normalized values of the gunshot's sound intensity (sound intensity vs time plot). The lower graph is the result of an FFT of the raw data (a frequency domain plot) for the shaded time period of 0.11 seconds shown within the upper plot. The FFT's x-axis is frequency (Hz) and its associated power (dB) on the y axis.
Figure 3:
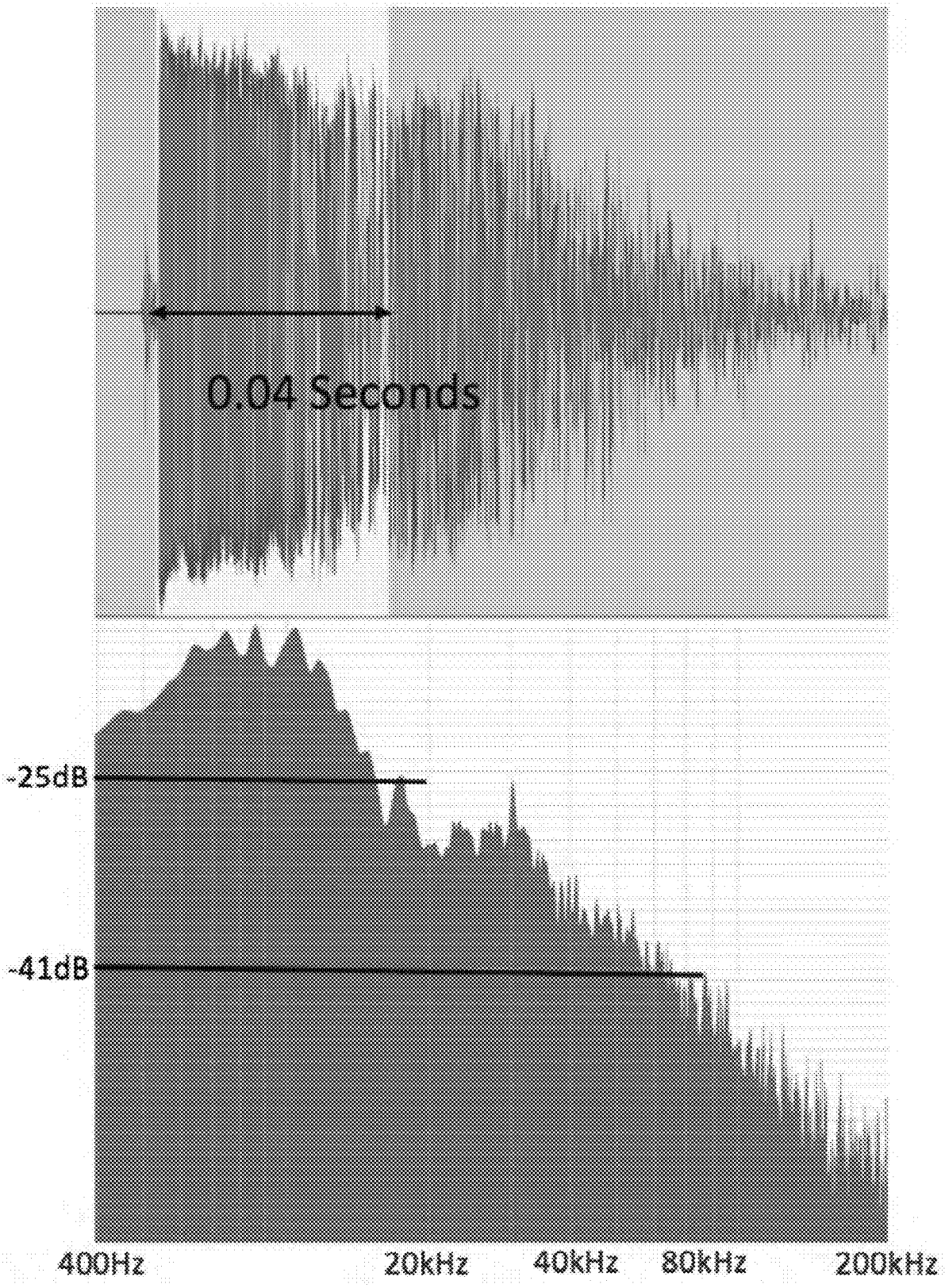
Figure 4:
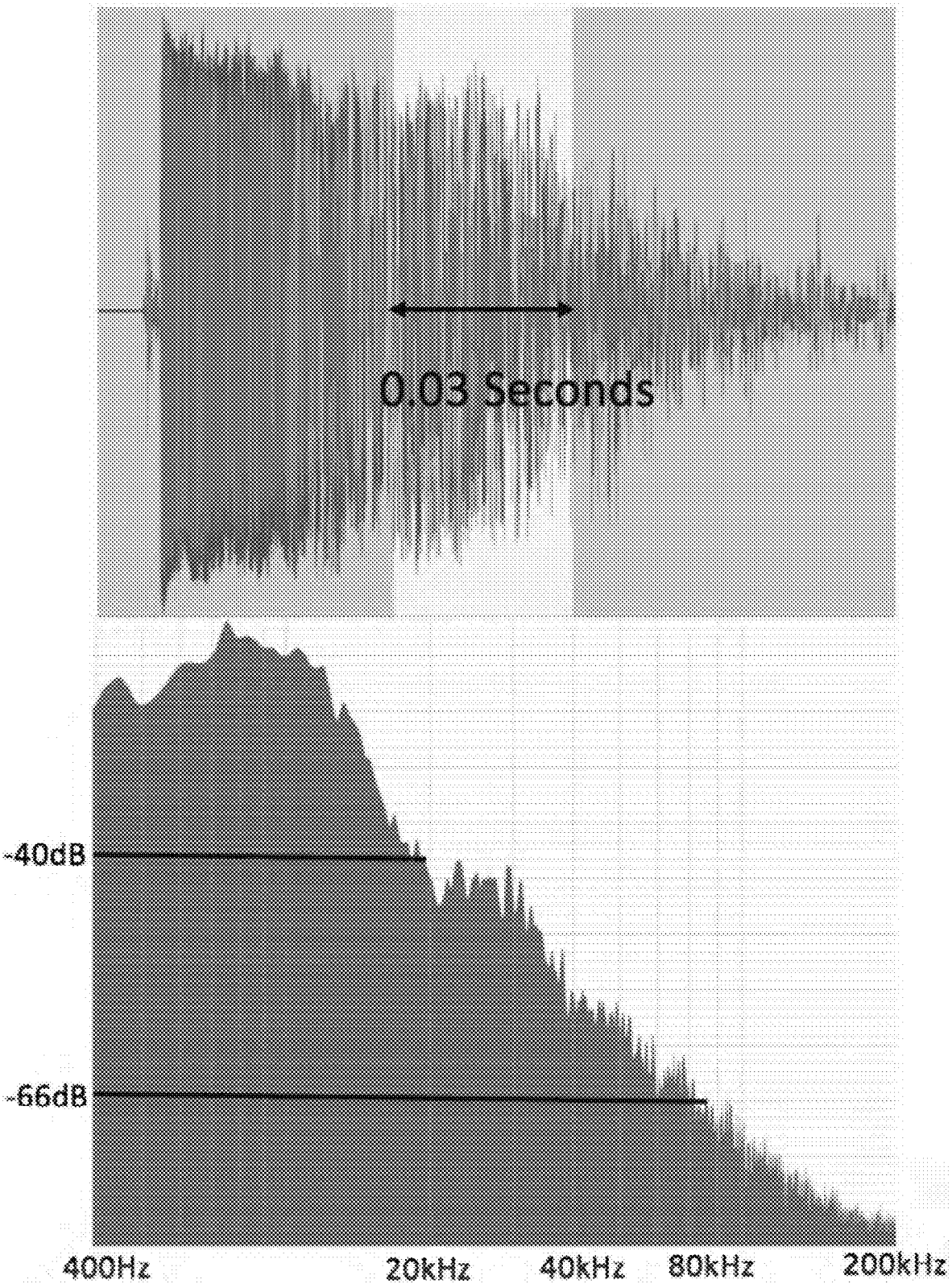
Figure 5:
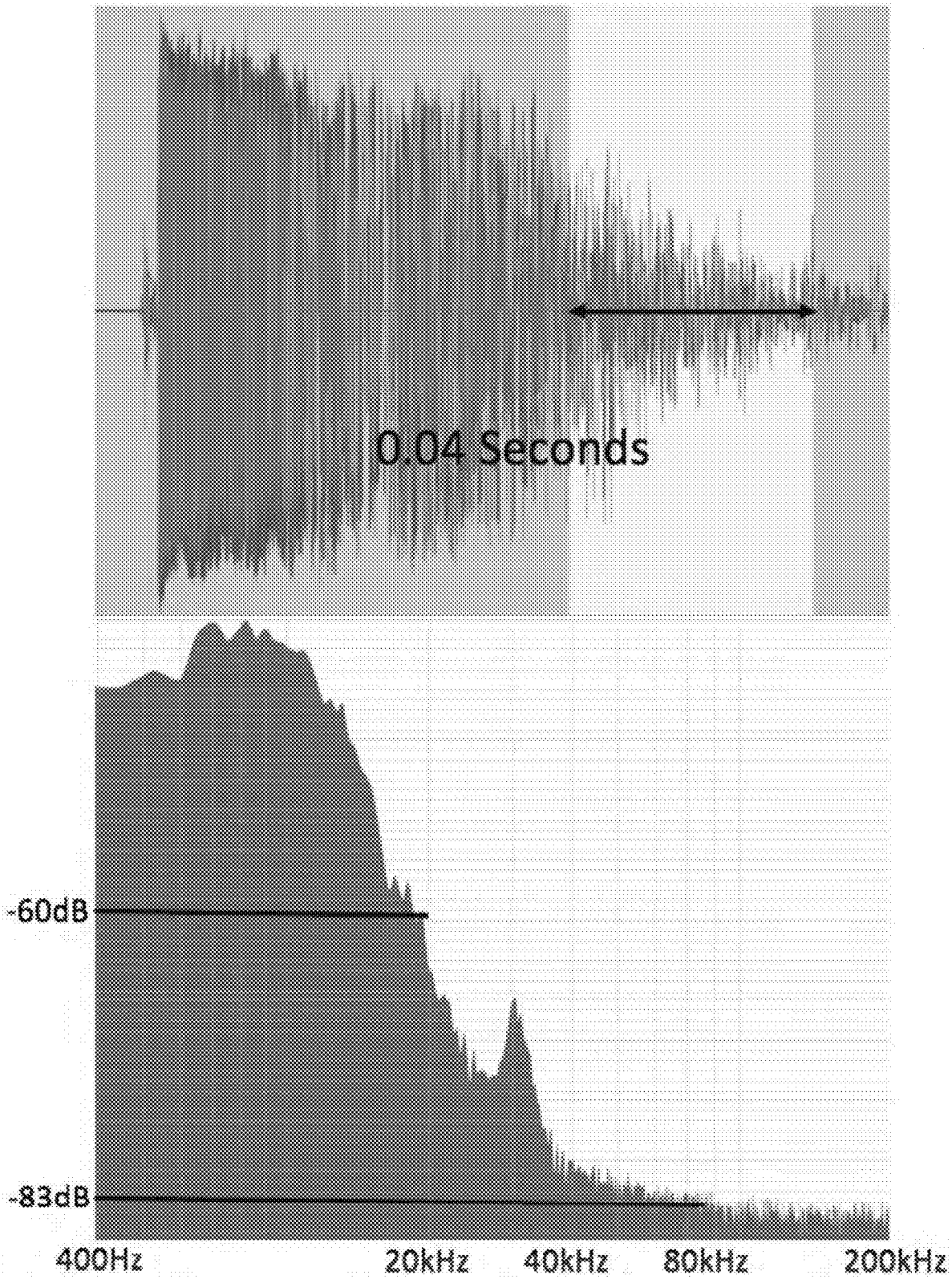

With further reference to the drawings, FIG. 1 shows a gunshot muzzle blast and the shockwave generated thereby as generally describe above. Further, FIG. 2 graphs substantially all of a gunshot blast. FIG. 3 shows the initial portion of that gunshot blast of FIG. 2; FIG. 4 shows a center portion of the gunshot blast in FIG. 2 and FIG. 5 shows the trailing end of the gunshot of FIG. 2. Finally, FIG. 6 shows the initial burst of sound of the gunshot in FIG. 2.

Referring to FIG. 2, it is seen that the power spectrum of a sampled gunshot is at odds with prior art teachings. More particularly, the upper graph of FIG. 2 demonstrates that a gunshot's spectrum is not contained within the known human hearing range. FIG. 2 does not show a gunshot's precipitous drop-off in power as its frequency is plotted beyond 5 kHz, as described in prior art. FIG. 2 does show an abundance of ultrasonic sound generated by the gunshot's muzzle blast that was not previously acknowledged or taught by prior art up to 200 kHz.

With regard to FIG. 3, the first portion of a Gunshot's sound waveform shown in the upper graph is transformed into its power spectrum as shown in the lower graph. By stepping through the waveform, the stepped transformations of the sound waveform over specific time intervals into frequency domain plots show that the ultrasonic frequency content generated by a gunshot's muzzle blast diminishes over the lifespan of the event. Referring to FIG. 4, the center portion of a gunshot's sound waveform is being transformed into its power spectrum and the resulting power spectrum shows a reduction in the high-energy ultrasonic frequency content. Referring to FIG. 5, the trailing portion of a gunshot's sound waveform is transformed into its power spectrum and the resulting power spectrum further shows that the ultrasonic sound generated within the initial and center portions of the sound wave both contain significantly more high-energy ultrasonic frequency content than sampled here.

Figure 6:
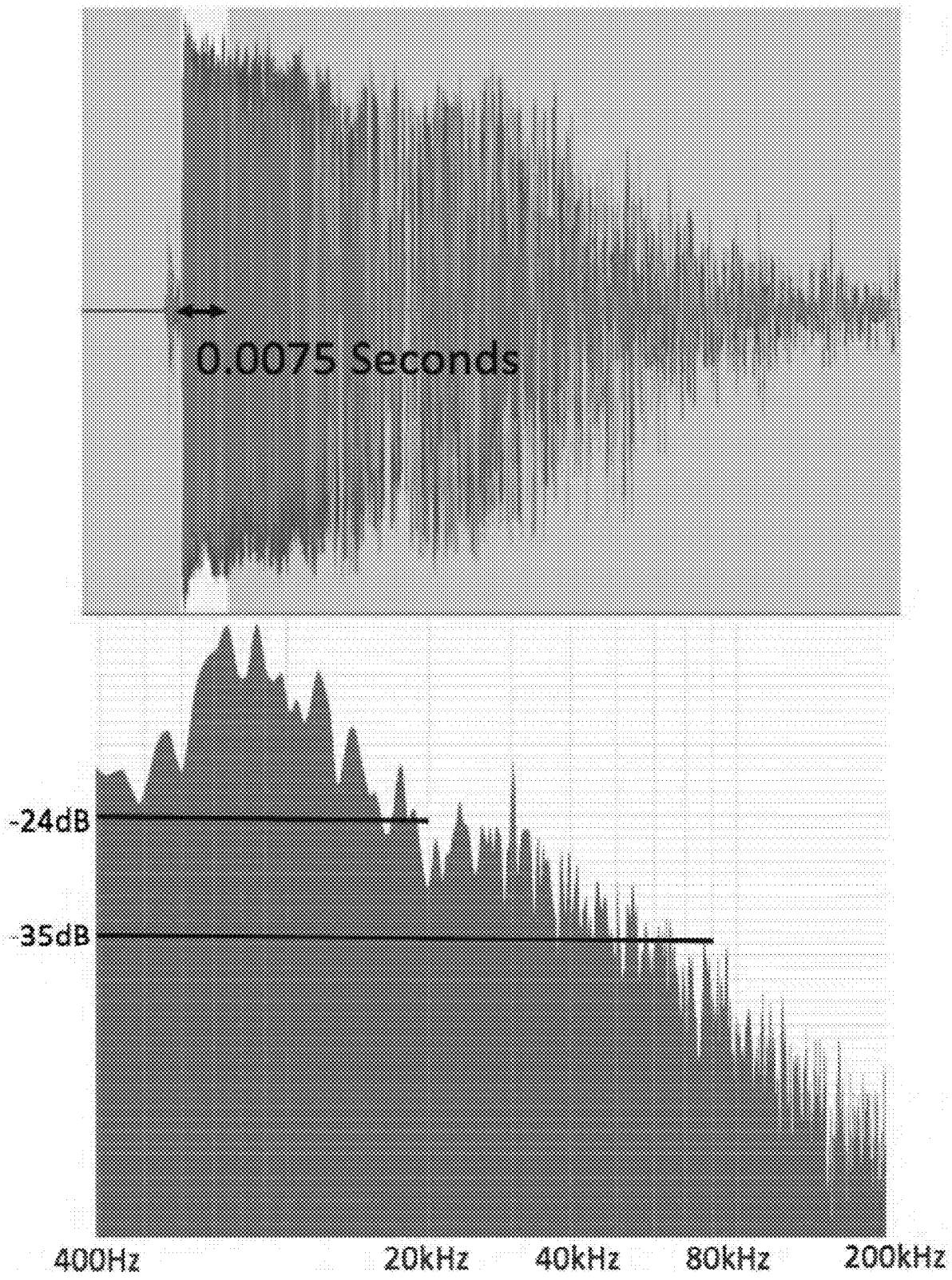

FIG. 6, focuses on the impulse or initial portion of a gunshot's sound waveform. The resulting power spectrum shows that the greatest portion of a gunshot's high-energy, wide-spectrum, ultrasonic sound content is contained within this short burst. Thereafter the generation of such ultrasonic frequency content decreases rapidly over the lifespan of resulting waveform.

Stepping through a gunshot's waveform provides insight into the distribution of its energy. Mathematically transforming the captured data by creating a spectrum of frequencies of the signal as it varies with time (spectrogram) is a superior way to visualize and record the variation of a waveform's energy. Referring to FIG. 7, a spectrogram of the 9 mm gunshot sound waveform is produced. This transformation of the sound waveform plots the Frequency on the Y-axis and Time on the X-axis and the waveform's intensity is now plotted by its color where numerical values correspond to the colors selected. Within FIG. 7, colors vary from low background intensity shown as light blue, then to pink, purple, red, and finally on to white being the highest intensity level measured. The resulting spectrogram shows the characteristic short-duration, high-energy, wide-spectrum, ultrasonic burst, that corresponds to the discovered unique ultrasonic Signature of a gunshot. In this instance, the Signature lasts for about 0.02 seconds-about 20% of the waveform's lifespan for a 9 mm outdoor gunshot.

The present systems and method further include determining whether the spectrogram or sampled portions thereof contains the characteristic short-duration, high-energy, wide-spectrum, ultrasonic burst, that corresponds to a unique ultrasonic signature of a gunshot in, for example, the library. As stated earlier, accurately detecting this acoustic idiosyncrasy which is uniquely produced by a gunshot requires advanced analytics and equipment capable of sampling, digitally storing, and processing sound data at ultra-high sampling rates as required by the Nyquist-Shannon sampling theorem. Such equipment at the time of this filing was not innately contained, exposed, or enabled within any smartphone, tablet, or computer. These devices were limited to CD quality sound having sampling rates of 44.1 kHz.

The current systems and methods provide for the capturing of audio. This step generally refers to the use of a microphone, and such capture may be accomplished with either an analog or a digital microphone. Current state-of-the-art microphones having digital outputs work well up to about 100 kHz. However, beyond that frequency their signal does not accurately represent the actual sampled waveform. The systems and methods contemplates that this technology will improve over time. For this reason, digital microphones may prove to be viable and their use is within the scope of the systems and methods such that the sampled audio signal is captured with such fidelity that the constituent ultrasonic frequencies are also retained and preserved.

Given the state of current digital microphones, an embodiment may use an analog microphone having a very wide frequency response that encompasses the constituent ultrasonic frequencies, allowing for these to be retained and preserved. For example, studio, reference, and monitor type equipment designed with the music professional may be inadequate when it comes to capturing and meeting the preferred frequency response. Given that short duration of the high-energy wide-spectrum ultrasonic impulse is a small fraction of the overall energy and given its wide distribution, the disclosed systems and methods contemplate not losing such information within the power spectrum.

Thus, by way of example, equipment having CD quality sound, having a typical defined sampling rate of 44.1 kHz, limiting the maximum frequency that may be captured digitally to 22 kHz. This upper limit is insufficient.

Some embodiments thus comprise a gunshot detection device or method that has or utilizes a processor, microphone, audio to digital conversion (ADC) technology, memory, and software processing logic that captures and/or processes digital audio signals up to 200 KHz, Analog Audio Capture, ADC and a Fast Fourier transformation processing capability, and allows for storage of the resulting digital audio signal. The resulting digital audio data may be stored in the gunshot detection device's memory on a rolling loop basis of sufficient size to accommodate the processing and communications limitations of the edge device. Such continuous rolling loop data storage process is known to the person of ordinary skill in art.

It is to be further understood that the rate of decay based upon frequency allows for calculating a signal back to its source. In other words, the distance from the fired gun (e.g., a shooter) may be determined using the full spectrum of the signal sampled at a given location. Given the eccentricity of the radiation pattern for low frequencies, building a robust sampling library from various distances, angles, guns, barrel lengths, calibers, and propellant loads is important. The preferred embodiment contemplates obtaining tens of thousands of sample spectrograms to be used for teaching its AI system to do the final comparison and to provide results that not only confirm that the source is a gunshot but provide a means for identifying the type of gun being used. Also, the distance from the fired gun (e.g., a shooter) may be determined using the full spectrum of the signal sampled at a given location. By taking the intensity of several ultrasonic frequencies at a discrete location and applying the International Standard document ISO 9613-1:1993 Part 1 "Calculation of the absorption of sound by the atmosphere," and applying the formulas within section 6.2, allows for deriving the relative distance from sample taken to its point source. It is also possible to use such a library of gunshot data, essentially arrays of values of intensity, time, and frequency (spectrograms), and using correlation to determine the best match. Both methods provide very good results for determining other key information such as gun type, ammunition type, direction of shot, etc.

Some embodiments may further include publishing the determination. This publishing process may be performed using a plethora of wired or wireless communications methods from the gunshot detection device to one or more subscribers or recipients of gunshot event data. A device or method may incorporate one or more communications technologies and methodologies, or may be connected to one or more wired or wireless communications devices that serve as a data transport mechanism for a gunshot detection device to publish gunshot event data. Gunshot event publishing data can, but is not limited to, being transmitted via local area wired network servers and access points; telephone lines; powerline network connectivity; Wi-Fi, Bluetooth and other wireless connectivity to local devices such as Wi-Fi or Bluetooth access points, Bluetooth receivers, nearby smartphones and other local devices with Wi-Fi, Bluetooth, Near Field Communications; Infrared or Ultraviolet optical signaling; Ultrasound signaling; ZigBee; Mesh Network; and other local area data communications methods and technologies. Gunshot event messages can also be transmitted wirelessly via wide-area AARL radio, 3G, 4G-LTE, 5G, LTE-M, NB-IoT, SigFox, LMR data, 900 Mhz and other public open access radio frequency bands, television network sideband datacasting, BGAN and other satellite data communications technologies, and any number of other existing and future wide-area wired or wireless communications networks and technologies. Nothing in this description limits the publication of gunshot event data or precludes the use of any method or system to communicate and publish such information.

A gunshot detection device may also publish additional information such as a device serial number, location, and gunshot date and timestamp. The device and/or method may capture and send NMEA or other GPS message data. The device may further be able to establish an audio communications channel and transmit live audio from the device microphone over a local or wide area network so that First Responders can listen to live audio being broadcast from a preferred embodiment that has detected a gunshot event.

Current embodiments may further transmit captured information to a second location such as a nearby personal body camera; an in-car video recording device, a first responder data center; a building or campus security system processing server; smart speaker; a Cloud-based processing center, or any other external processor. In such a situation, the second location's processor may compare the candidate gunshot audio data to a collection of known gunshot audio signatures previously captured or otherwise obtained.

Either internal to the gunshot detection device or by means of an external processor, it may be determined that a given candidate gunshot dataset most closely matches a previously captured gunshot signature maintained in the library. This operation can be performed by correlation or the use of an Artificial Intelligence engine maintained in the Cloud. Moreover, other detailed metadata about the Gunshot Detection event such as type of weapon, caliber of the projectile, distance of the shooter from the gunshot detection device, and compass heading of the shooter from the gunshot detection device, are examples of the information that can also be determined.

It is to be further understood that a gunshot detection device and methods may be placed in various locations, either fixed or mobile. For example, a future smartphone may be provided with an audio subsystem that is able to capture gunshot audio within the ultrasonic spectrum, and thereby, with the appropriate software, serves as a mobile Gunshot Detector. In an alternative embodiment, a Gunshot Detector could be an appliance that plugs into a 110 volt AC electrical outlet to provide Gunshot Detection inside a room, hallway, auditorium, chapel, retail location, school classroom, courthouse, police station, media studio, hotel, restaurant, hospital room or corridor, sports stadium, transit stop/station, or public park. The Gunshot Detector could be mounted on a Smart Cities power pole, affixed to the outside of a building, or to any number of other internal or external fixed locations.

The technologies described herein may be implemented in various ways, including as computer program products comprising memory storing instructions causing a processor to perform the operations associated with the above technologies. The computer program product comprises a tangible, non-transitory computer readable storage medium storing applications, programs, program modules, scripts, source code, program code, object code, byte code, compiled code, interpreted code, machine code, executable instructions, and/or the like (also referred to herein as executable instructions, instructions for execution, program code, and/or similar terms). Such tangible, non-transitory computer readable storage media include all the above identified media (including volatile and non-volatile media), but does not include a transitory, propagating signal. Non-volatile computer readable storage medium may specifically comprise: a floppy disk, flexible disk, hard disk, magnetic tape, compact disc read only memory ("CD-ROM"), compact disc compact disc-rewritable ("CD-RW"), digital versatile disc ("DVD"), Blu-ray™ disc ("BD"); any other non-transitory optical medium, and/or the like. Non-volatile computer-readable storage medium may also comprise read-only memory ("ROM"), programmable read-only memory ("PROM"), erasable programmable read-only memory ("EPROM"), electrically erasable programmable read-only memory ("EEPROM"), flash memory, and/or other technologies known to those skilled in the art.

Many modifications and other embodiments of the concepts and technologies set forth herein will come to mind to one skilled in the art having the benefit of the teachings presented in the foregoing descriptions and the associated drawings. Therefore, it is to be understood that embodiments other than the embodiments disclosed herein are intended to be included within the scope of the appended claims. Although specific terms may be employed herein, they are used in a generic and descriptive sense only and not for purposes of limitation

What is claimed:

1. A method for determining the occurrence of a gunshot comprising:

a) capturing a sound signal digitally with such fidelity that the constituent frequencies that comprise its ultrasonic frequencies are retained and preserved, wherein the sampling rate used to capture and preserve the frequency information of the digital signal is in a range from 48 kHz to 384 kHz;

b) mathematically transforming the frequency information by creating a spectrogram having a spectrum of frequencies of the signal as it varies with time or a spectrum of frequencies over a short period of time; and c) determining whether the spectrogram or spectrum or sampled portions of the spectrogram or spectrum contains an ultrasonic burst that corresponds to an ultrasonic signature of a gunshot having contiguous ultrasonic component sound frequency content that includes an entire spectrum of frequencies in a range of 20 kHz up to 192 kHz.

2. The method of claim 1 wherein the step of capturing a sound signal includes sampling the sound source at a sampling rate that is at least twice the highest discrete ultrasonic frequency sought to be captured.

3. The method of claim 1 wherein the step of mathematically transforming utilizes calculating a Fast Fourier Transformation in accordance with any known FFT algorithm.

4. The method of claim 1 wherein the step of mathematically transforming utilizes calculating a Fast Fourier Transformation in accordance with known FFT implementation.

5. The method of claim 1, wherein the frequency information is mathematically transformed by creating a spectrogram having a spectrum of frequencies of the signal as it varies with time, the method further comprising detecting an impulse prior to executing the mathematical transformation step that yields the spectrogram.

6. The method of claim 1 further comprising transmitting the captured sound signal to a second location for storage or further processing.

7. The method of claim 1, wherein the frequency information is mathematically transformed by creating a spectrogram having a spectrum of frequencies of the signal as it varies with time, the method further comprising transmitting said spectrogram to a second location for storage or further processing.

8. The method of claim 1, wherein the frequency information is mathematically transformed by creating a spectrum of frequencies over a short period of time, the method further comprising transmitting said spectrum to a second location for storage or further processing.

9. The method of claim 1 further comprising transmitting the captured sound signal to a second location prior to executing the mathematical transformation step that yields the spectrogram.

10. The method of claim 1 wherein the step of determining a gunshot utilizes a correlation function to determine whether the spectrogram or spectrum corresponds to a known ultrasonic signature of a gunshot.

11. The method of claim 1 wherein the step of determining a gunshot utilizes Artificial Intelligence to determine whether the spectrogram or spectrum corresponds to a known ultrasonic signature of a gunshot.

12. A method for accurately determining the occurrence of a gunshot comprising:

a) capturing a sound signal, either digital or analog, with such fidelity that the constituent frequencies that comprise its ultrasonic frequencies are retained and preserved, wherein at least one bandpass filter is utilized to capture one or more discrete component sound frequencies within a range from 20 kHz to 192 kHz; and b) determining whether said one or more discrete component sound frequencies are consistent with an ultrasonic burst that corresponds to an ultrasonic signature of a gunshot having contiguous ultrasonic component sound frequency content that includes an entire spectrum of frequencies in a range of 20 kHz up to 192 kHz.

13. The method of claim 12 further comprising detecting an impulse prior to filtering.

14. The method of claim 12 further comprising transmitting the captured sound signal to a second location prior to filtering.

15. The method of claim 12 wherein the step of determining a gunshot utilizes a correlation function to determine whether the discrete component sound frequencies correspond to a known ultrasonic signature of a gunshot.

16. The method of claim 12 wherein the step of determining a gunshot utilizes Artificial Intelligence to determine whether the discrete component sound frequencies correspond to a known ultrasonic signature of a gunshot.

17. A detection device for determining the occurrence of a gunshot comprising:

a) a microphone that is capable of capturing sound frequencies within the ultrasonic spectrum, above 20 kHz, for capturing a sound signal;

b) an analog to digital converter for converting the microphone's analog sound signal to a digital sound signal;

c) a processing circuit for processing and analyzing the resulting digital sound signal; and d) a data storage device for retaining and preserving any captured or analyzed data wherein:

said microphone and analog to digital converter capture a digital sound signal with such fidelity that the constituent frequencies that comprise the ultrasonic spectrum are retained and preserved;

said processing circuit analyzes the captured digital sound signal for frequency information in a range from 20 kHz to 192 kHz;

said processing circuit mathematically transforms the digital information by creating a spectrogram having a spectrum of frequencies of the signal as it varies with time or a spectrum of frequencies over a short period of time;

said processing circuit determines whether said spectrogram or spectrum or sampled portions of the spectrogram or spectrum contain an ultrasonic burst, that corresponds to a known ultrasonic signature of a gunshot having contiguous ultrasonic component sound frequency content that includes an entire spectrum of frequencies in a range of 20 kHz up to 192 kHz; and said storage device retains and preserves the data as it is captured, transformed and used for determination.

18. The detection device of claim 17 wherein, responsive to a gunshot determination, the processing circuit records at least one of a date and time of occurrence of the determination.

19. The detection device of claim 17 wherein said device includes a GPS receiver for acquiring the geographic location of the system.

20. The detection device of claim 17 wherein said device includes a mounting system wherein:

a) said mounting system integrates with a standard wall outlet; and b) said mounting system utilizes the wall outlet receptacle as a source of power and alignment.

21. The detection device of claim 20 further comprising a mounting system that utilizes a security fastener to prevent unwarranted removal.

22. The detection device of claim 17 wherein said device includes means for electronically publishing a report.

23. A detection device for determining the occurrence of a gunshot comprising:

a) a microphone capable of capturing sound frequencies within the ultrasonic spectrum, above 20 kHz, for capturing a sound signal;

b) an analog to digital converter for converting the microphone's analog sound signal to a digital sound signal or at least one filtering circuit;

c) a processing circuit for processing and analyzing the resulting digital sound signal;

d) a data storage device for retaining and preserving any captured or analyzed data wherein:

the microphone and analog to digital converter capture a digital sound signal with such fidelity that the constituent frequencies that comprise the ultrasonic spectrum are retained and preserved;

the processing circuit or the at least one filtering circuit applies a bandpass filter(s) to capture discrete component sound frequencies within a range from 20 kHz to 192 kHz;

the processing circuit determines whether the discrete component sound frequencies are consistent with the characteristic ultrasonic burst, that corresponds to the known ultrasonic signature of a gunshot having contiguous ultrasonic component sound frequency content that includes an entire spectrum of frequencies in a range of 20 kHz up to 192 kHz; and said storage device is for retaining and preserving the data as it is captured, transformed and used for determination.

24. The detection device of claim 23 further comprising a sensor for detecting an impulse prior to filtering.

25. The detection device of claim 23 wherein said device includes a transmitter for conveying data and a receiver for receiving data.

26. The detection device of claim 23 wherein said device includes a display screen.

* * * * *